US012601527B2

(12) United States Patent
Kent et al.

(10) Patent No.: US 12,601,527 B2
(45) Date of Patent: Apr. 14, 2026

(54) HEAT EXCHANGE SYSTEM

(71) Applicant: MAHLE INTERNATIONAL GMBH, Stuttgart (DE)

(72) Inventors: Scott Kent, Albion, NY (US); Robert Louis Runk, Lockport, NY (US); Lindsey Lee Leitzel, Lockport, NY (US); Szymon Walczak, Ostrow-Wielkopolski (PL)

(73) Assignee: MAHLE International GmbH, Stuttgart (DE)

( * ) Notice: Subject to any disclaimer, the term of this patent is extended or adjusted under 35 U.S.C. 154(b) by 300 days.

(21) Appl. No.: 18/388,577

(22) Filed: Nov. 10, 2023

(65) Prior Publication Data

US 2025/0155167 A1 May 15, 2025

(51) Int. Cl.
*F25B 13/00* (2006.01)
*F25B 41/31* (2021.01)

(52) U.S. Cl.
CPC ..... *F25B 13/00* (2013.01); *F25B 41/31* (2021.01); *F25B 2313/02731* (2013.01); *F25B 2313/02741* (2013.01)

(58) Field of Classification Search
CPC ..... F25B 13/00; F25B 41/31; F25B 2313/02731; F25B 2313/02741
See application file for complete search history.

(56) References Cited

U.S. PATENT DOCUMENTS 9,488,395 B2 11/2016 Matsumoto et al.
9,752,803 B2 9/2017 Matter, III et al.
2006/0243432 A1 11/2006 Demuth et al.
2009/0027671 A1 1/2009 Jarrell
2015/0107286 A1* 4/2015 Jin ..... F25B 13/00 62/324.6
2019/0049194 A1 2/2019 Yanik et al.
(Continued)

FOREIGN PATENT DOCUMENTS

CN 103644685 3/2014
CN 103644685 A 3/2014
(Continued)

OTHER PUBLICATIONS

Response to Examination report for related EP 24201058.5 submitted Jul. 31, 2025.
(Continued)

*Primary Examiner* — Larry L Furdge
(74) *Attorney, Agent, or Firm* — Barnes & Thornburg

(57) ABSTRACT

A heat exchange system for controlling heat within an indoor space is provided. The system includes a heat exchanger located within the indoor space and a dual flow heat exchanger that is located in a space that is not temperature regulated by the system. The outdoor dual flow heat exchanger has flow through two different pluralities of parallel tubes that are interspersed between each other. The system includes a first expansion valve located within the indoor space to receive flow from one of the two sets of parallel tubes and cause flow to the indoor heat exchanger. The system includes a second expansion valve located in the non-temperature regulated space, wherein the second expansion valve receives flow from the second set of tubes and returns expanded lower pressure flow to the first set of tubes.

25 Claims, 9 Drawing Sheets

(56) References Cited

U.S. PATENT DOCUMENTS

| | | | | |
|---|---|---|---|---|
| 2020/0191501 | A1* | 6/2020 | Pelletier | F28F 9/026 |
| 2020/0355439 | A1* | 11/2020 | Mercer | F28D 7/0066 |
| 2022/0221226 | A1 | 7/2022 | Runk et al. | |
| 2022/0243989 | A1 | 8/2022 | Zhong et al. | |

FOREIGN PATENT DOCUMENTS

| | | | |
|---|---|---|---|
| CN | 107218822 | | 9/2017 |
| CN | 109595951 | | 4/2019 |
| CN | 111322795 | | 6/2020 |
| DE | 102012003526 | | 8/2013 |
| DE | 102014203895 | | 8/2018 |
| EP | 1762808 | | 3/2007 |
| EP | 1856500 | | 11/2007 |
| EP | 3492839 | A1 | 5/2019 |
| EP | 3798535 | | 3/2021 |
| FR | 2899959 | | 10/2007 |
| WO | 2004/074756 | | 9/2004 |
| WO | 2006/083511 | | 8/2006 |
| WO | 2012/112802 | | 8/2012 |
| WO | 2020/259671 | | 12/2020 |
| WO | 2021/250738 | | 12/2021 |

OTHER PUBLICATIONS

EP Search Report; Appln. No. 24201058.5, dated Mar. 19, 2025.
Search Report & Written Opinion issued in PCT/EP2023/074327 (Nov. 9, 2023).

* cited by examiner

HEAT EXCHANGE SYSTEM

TECHNICAL FIELD

This disclosure relates to heat pump systems that are configured to allow for reversible flow and specifically to heat pump systems that are configured to operate in environments where the environmental temperature can be on the order of freezing or lower.

BRIEF SUMMARY

A first representative embodiment of the disclosure is provided. The embodiment includes a heat exchange system. The heat exchange system includes a first heat exchange assembly that is configured to be disposed in an outdoor space configured for outside air to flow therethrough, the first heat exchange assembly includes a first set of tubes that are arranged in a parallel flow manner between a first manifold and a second manifold, wherein straight portions of adjacent tubes within the first set of tubes are disposed with a space therebetween along each tube of the first set of tube between the first and second manifolds. A second set of tubes are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes. A second heat exchanger is disposed within an interior space, wherein the second heat exchanger comprises first and second manifolds that are disposed at opposite ends of one or more flowpaths that are fluidly connected with both of the first set of tubes and the second set of tubes. The system further includes a compressor, and an expansion valve. In a first mode of operation refrigerant that flows through the compressor reaches the compressor after flowing through the second set of tubes and upon leaving a compressor outlet flows through the first set of tubes.

Another representative embodiment of the disclosure is provided. The embodiment includes a heat exchange system. The system includes a first heat exchange assembly that is configured to be disposed in an outdoor space configured for outside air to flow therethrough. The first heat exchange system includes a first set of tubes that are arranged in a parallel flow manner between a first manifold and a second manifold, wherein straight portions of adjacent tubes within the first set of tubes are disposed with a space therebetween along each tube of the first set of tube between the first and second manifolds, and a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes. The system additionally includes a second heat exchanger that is disposed within an interior space, wherein the second heat exchanger comprises first and second manifolds that are disposed at opposite ends of one or more flowpaths that are fluidly connected with both of the first set of tubes and the second set of tubes, a compressor, and an expansion valve. In a first mode of operation refrigerant that flows through the compressor reaches the compressor after flowing through the second set of tubes and upon leaving a compressor outlet flows through the first set of tubes, and in a second mode of operation refrigerant that flows through the compressor reaches the compressor after flowing through the first set of tubes and upon leaving the compressor outlet flows through the second heat exchanger before flowing through the second set of tubes.

Yet another representative embodiment of the disclosure is provided. The embodiment includes a method of operating a heat exchange system in order to operate a second heat exchanger within an indoor space to selectively provide cooling in the indoor space and provide heating in the indoor space. The method includes the steps of providing a second heat exchanger that is disposed within an interior space, wherein the second heat exchanger comprises first and second manifolds that are disposed at opposite ends of one or more flowpaths that are fluidly connected with both of the first set of tubes and the second set of tubes, and providing a first heat exchange assembly that is configured to be disposed in an outdoor space configured for outside air to flow therethrough, the second heat exchange assembly includes a first set of tubes that are arranged in a parallel flow manner between a first manifold and a second manifold, wherein straight portions of adjacent tubes within the first set of tubes are disposed with a space therebetween along each tube of the first set of tube between the first and second manifolds, and a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes. The method also includes the steps of operating a compressor, and providing an expansion valve such that refrigerant flows through the system flows through the expansion valve, when desired to provide cooling within the indoor space, operating the system in a first mode of operation, aligning the system such that refrigerant that flows through the compressor reaches the compressor after flowing through the second set of tubes and upon leaving a compressor outlet flows through the first set of tubes, and when desired to provide heating within the indoor space, operating the system in the second mode of operation, aligning the system such that refrigerant that flows through the compressor reaches the compressor after flowing through the first set of tubes and upon leaving the compressor outlet flows through the second heat exchanger before flowing through the second set of tubes.

The embodiments above can be modified by one or more structures or method as described in the Representative Paragraphs of the specification below.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

DETAILED DESCRIPTION OF THE PREFERRED EMBODIMENTS

Figure 1:
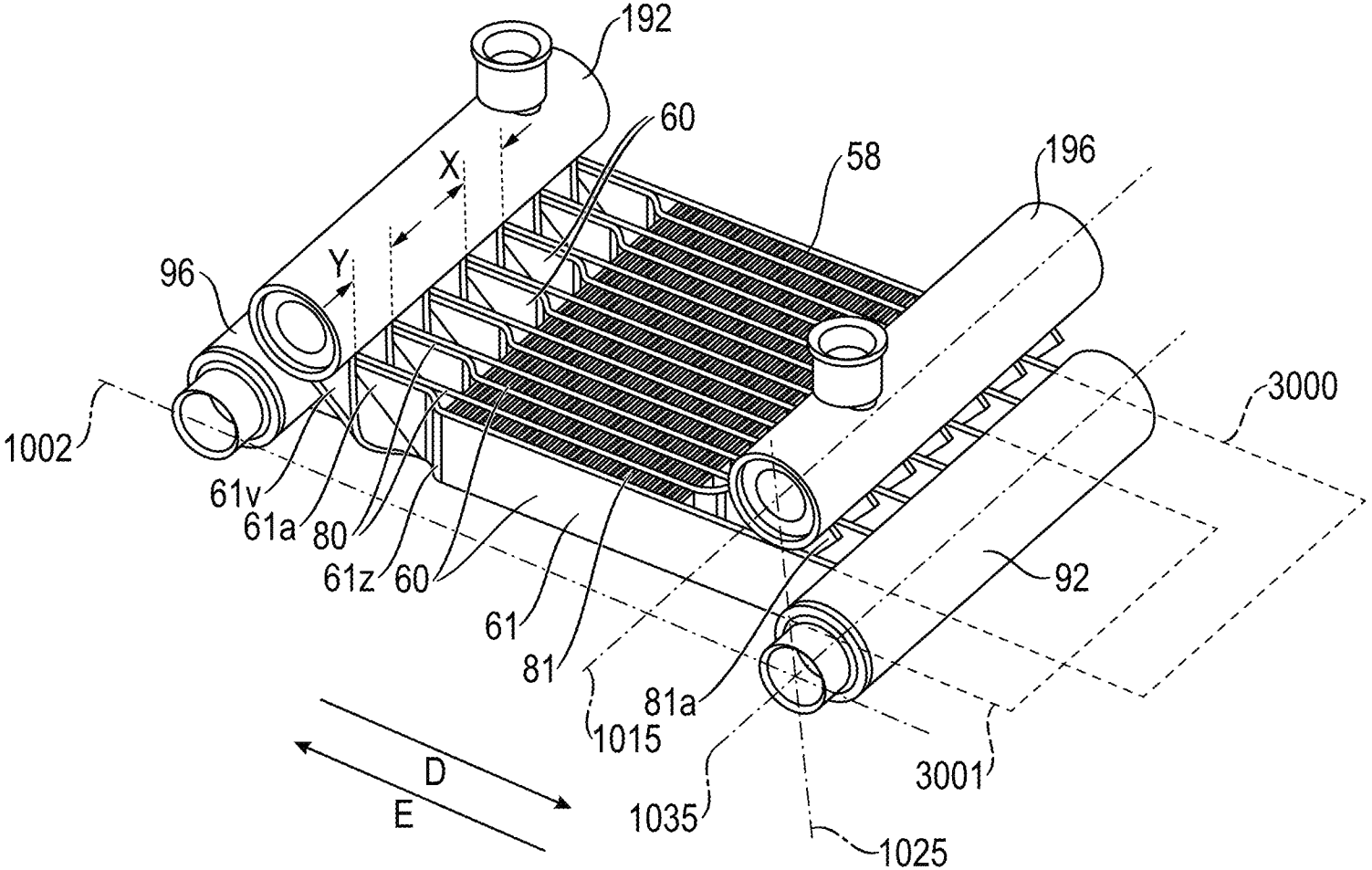
FIG. 1 is a perspective view of a heat exchanger for use in the systems depicted in the remaining figures, that is positioned in an outside space or a space that is not temperature controlled by the system.

Turning now to FIGS. 1-8 a heat exchange system 10 is provided. The heat exchange system 10 is configured to be operable in two different configurations, a first where a heat exchanger in an indoor environment provides cooling to the indoor environment (either by cooling a fluid that flows through the heat exchanger, or by cooling a space within the indoor environment) and a second where the heat exchanger in the indoor environment provides heat to the indoor environment (either by heating a fluid that flows through the heat exchanger, or by heating a space within the indoor environment). The system 10 therefore operates with the indoor heat exchanger operating as an evaporator when it is to provide cooling and a condenser when it is to provide heating. In other embodiments, the system 10 may be operable only as a cooling system for the second heat exchanger 300 (discussed below) and not configured to operate in a reversible manner. One of ordinary skill in the art with a thorough review of this specification would readily understand how to implement the system (using the dual flow heat exchanger 50 and the second heat exchanger 300) to allow for only cooling and the appropriate changes to the piping (due to the removed need to allow for the refrigeration system to operate with the second heat exchanger 300 being a condenser and to provide heat to the interior space (12)) and the changes to only include direct flow paths as needed in the system for the cooling scenario (e.g. operates only in as in FIG. 1*a* and not as in FIG. 1*b*, below) with only routine optimization and experimentation. The remaining portions of the specification are described specifically with a system that can operate both in inner cooling (FIG. 1*a*) and inner heating modes (FIG. 1*b*) for the sake of brevity.

The heat exchange system 10 is best understood with reference to FIGS. 1*a*-8, which schematically depict a first representative embodiment of the heat exchange system 10 in heating and cooling modes, respectively. The heat exchange system includes a heat exchanger 300 that is disposed within an indoor space 12—or in some embodiments a space that is desired to be conditioned by the system. In some embodiments, the indoor space 12 may be a space within an enclosed space that that includes one or more barriers between the inside space and the outside elements. The heat exchanger 300 receives refrigerant through one of the first and second manifolds 300*a*, 300*b* with refrigerant leaving the heat exchanger 300 via the other of the first and second manifolds 300*a*, 300*b*. The heat exchanger 300 may be a dual flow heat exchanger where a second fluid to be cooled or heated by the refrigerant that flows through the first and second manifolds 300*a*, 300*b* also flows, or the heat exchanger 300 may itself be a source of cooling or heating with the environment around the heat exchanger interacting with the heat exchanger or gain from or lose heat to the heat exchanger 300. The details of the heat output from, or the receipt of heat into the refrigerant flowing through the heat exchanger is not depicted in the schematic depiction of the heat exchanger 300 in the figures of this application—and the operation of the system 10 is the same regardless of the type of heating and cooling provided within the indoor environment (12) of the heat exchanger 300.

A second heat exchanger system 50 is provided and is disposed within an outdoor space 14, or a space that fully or at least partially open the outside environment. (Different types of heat exchanger systems 50 are discussed in detail below, each operates in the same manner as the second heat exchanger system otherwise described herein). The outdoor space 14 is provided to allow outside air, that is not fully, or in some embodiments is not at all subject to active cooling or heating, to serve as a heat source or a heat sink (depending upon the mode of operation of the system 10) to the second heat exchange system 50. The system 10 further includes a compressor 32 and first and second expansion valves 122, 124 that are selectively aligned to receive refrigerant flow therethrough depending upon the mode of operation of the system as discussed herein. The expansion valves 122, 124 are discussed below.

Figure 1A:
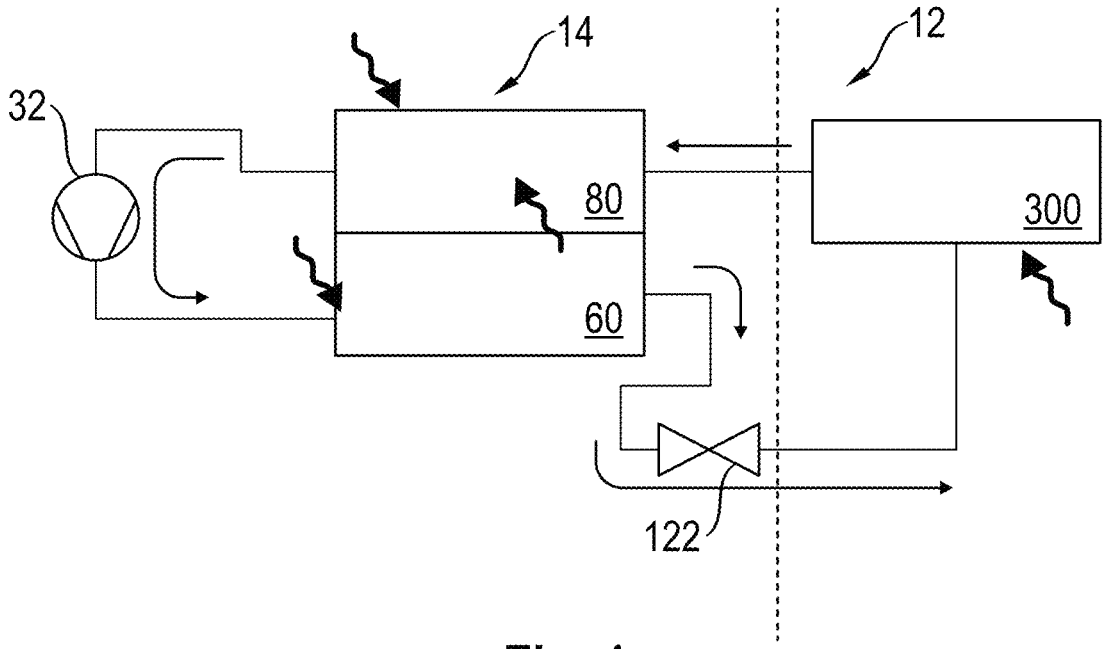
FIG. 1*a* is a schematic flow diagram of a system that is operating in cooling mode, with the second set of tubes (80) within the heat exchanger of FIG. 1 acting as a superheater and the first set of tubes (60) within the heat exchanger of FIG. 1 acting as a condenser. The second heat exchanger (300) is acting as evaporator. The curved arrows in the figure schematically depict the direction of heat flow with respect to the various components of the system.

FIG. 1*a* depicts the system 10 aligned to provide cooling to (i.e. remove heat from) the indoor space 12 (or components or fluid within the indoor space). As depicted by the arrow pointing toward the second heat exchanger 300, heat flows into the second heat exchanger and is removed from the second heat exchanger via the refrigerant—which causes the second heat exchanger to cool the indoor space or objects or liquid within the indoor space. In this embodiment, the second heat exchanger 300 operates as an evaporator, with the evaporation of the refrigerant (that enters the second heat exchanger 300 from the expansion valve) the heat input used to cause the liquid/vapor combination entering the second heat exchanger 300 to become entirely vapor (quality 1.0) and the heat transferred into the second exchanger is the latent heat of vaporization and if sufficient increases the temperature of the refrigerant vapor as it flows through the second heat exchanger 300). The refrigerant vapor flows to the second set of tubes 80 within the first heat exchanger. The refrigerant flowing therethrough becomes superheated (as evidenced from the schematic showing of heat flowing through the environment into the second set of tubes, and the schematic showing of heat flowing from the first set of tubes 60 to the second set of tubes. Accordingly, refrigerant flowing through second set of tubes 80 becomes superheated vapor.

Refrigerant then flows through the compressor 32, where the pressure of the refrigerant is increased, thereby increasing the saturation temperature of the refrigerant. Refrigerant flows then to the first set of tubes 60. The high pressure refrigerant entering the first set of tubes 60 gives off heat due to the latent heat of condensation (to the environment and to the second set of tubes 80 as discussed above) and the refrigerant condenses to a quality of zero (preferably with a few degrees of subcooling).The refrigerant (now in liquid form) flows then to the expansion valve 122, which expands and decreases the pressure of the refrigerant before it returns to the second heat exchanger 300 to continue the cycle as discussed above.

Figure 1B:
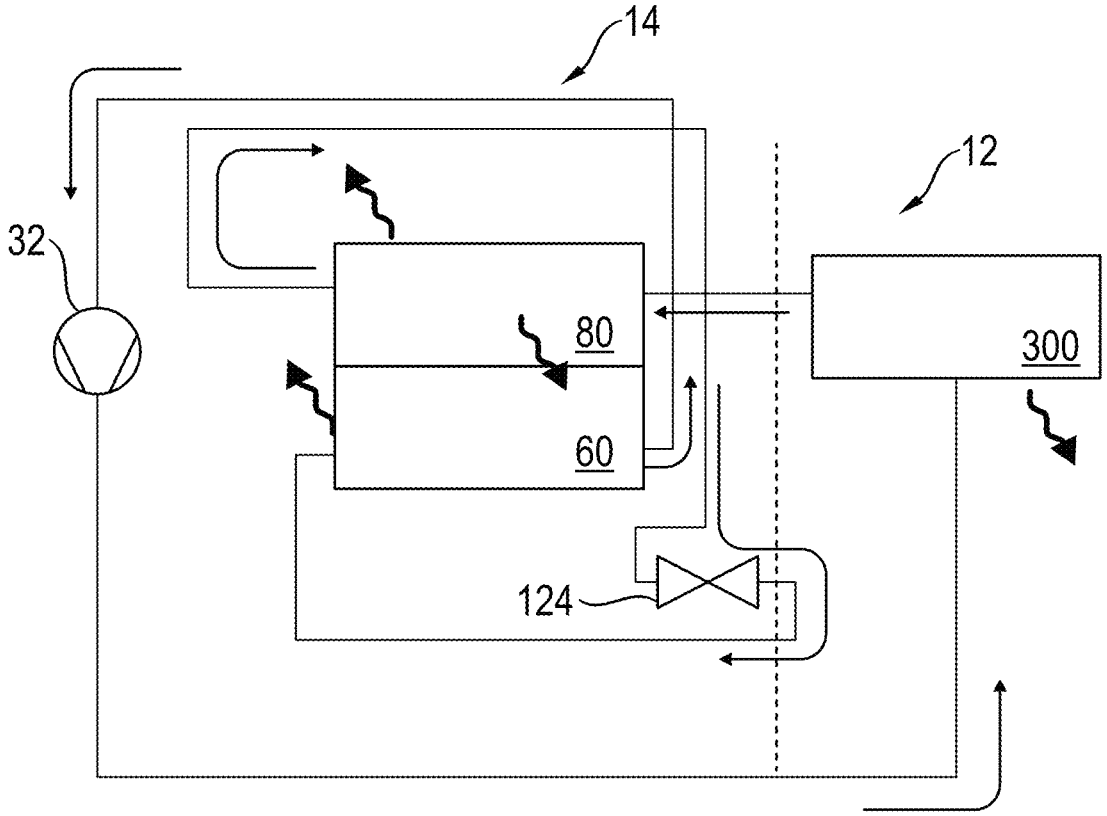
FIG. 1*b* is a schematic flow diagram of the system of FIG. 1*a* that is re0aligned for heating mode, with the second set of tubes (80) acting as a subcooler and the first set of tubes (60) acting as an evaporator. The second heat exchanger (300) is acting as a condenser. The curved arrows in the figure schematically depict the direction of heat flow with respect to the various components of the system.

FIG. 1*b* depicts the system 10 when aligned to add heat to the indoor space 12. In this orientation, the second heat exchanger 300 receives refrigerant from the compressor 32, which raises the pressure of the refrigerant (which is typically entirely vapor from the compressor—or with a quality that approaches 1). Upon reaching the second heat exchanger 300, the surrounding environment is at a lower temperature and therefore heat transfers from the refrigerant flowing therethrough and to the environment as depicted schematically by the arrow from the second heat exchanger 300. This removal of heat causes the vapor to change to a liquid and the loss of heat is initially based upon the latent heat of condensation, and if more heat is lost results in a lowering of the refrigerant temperature that leaves the second heat exchanger 300.

Refrigerant flows from the second heat exchanger 300 to the second set of tubes 80 within the first heat exchanger as a high-pressure liquid. The second set of tubes 80 acts a subcooler due to the relatively higher temperature of the refrigerant in comparison to the environment. Heat also flows from the second set of tubes 80 to the refrigerant within the first set of tubes 60 as discussed below. The subcooled liquid leaves the second set of tubes and flows to the expansion valve 124 where the subcooled liquid is expanded to a liquid/vapor mix, which decreases the pressure of the refrigerant. The expanded liquid then flows to the first set of tubes 60 that acts as an evaporator—due to the receipt of heat from the second set of tubes 80, and receipt of heat from the environment. The refrigerant (now in a gaseous state—quality at 1 or close to 1) then flows to the compressor, which increases the pressure of the refrigerant, and the refrigerant again flows to the second heat exchanger 300 to begin the cycle again.

It will be understood that the operation of the system in both an indoor (12) cooling mode and a heat mode (FIGS. 1*a*, 1*b*, respectively) may require that various components are plumbed in the system such that refrigerant flows thereto in different orders and from different directions in each operational mode.

FIGS. 2-6 depict various schematic views of arrangements of various embodiments of the heat exchange system 10—and specifically depict various different plumbing arrangements of the system to achieve the functionality of the system in both different modes of operation as discussed above. One of ordinary skill in the art will readily comprehend after a thorough review and understanding of this specification that these are just some of the contemplated plumbing arrangements within the scope of the disclosure and which may be within the scope of the claims of this application. One of ordinary skill in the art will understand that other plumbing arrangements may be possible to achieve the functional results. For example, the embodiments below depict the use of two different expansion valves 122, 124 with one of the two being within the refrigerant flow path based upon the current mode of operation (i.e. cooling or heating the indoor second heat exchanger 300). In other embodiments, only a single expansion valve may be provided—with different plumbing than shown therein. In this embodiment, in the indoor cooling mode (i.e. schematic mode FIG. 1*a*)—plumbed system is arranged—due to various valve positions such that refrigerant from the first set of tubes 60 flows to the expansion valve and then to the second heat exchanger 300. In this embodiment, in the indoor heat mode (i.e. schematic mode FIG. 1*b*) the plumbed system is arranged—due to various valve positions such that refrigerant from the second set of tubes 80 flows to the expansion valve and then to the first set of tubes 60. Other modifications of the embodiments of FIGS. 2-5 may be provided to achieve the functionality of the system as described above (shown schematically in FIGS. 1*a* and 1*b*) and would be understood by one of ordinary skill in the art as within the scope of this disclosure and would be possible to be designed by one of ordinary skill without undue experimentation in order to achieve a design goal (e.g. limit the number of remotely operating valves needed, limit the length of piping needed between the compressor 32 and the second heat exchanger 300, and so on).

With continued reference to FIGS. 1*a* and 1*b*, and further reference to FIGS. 2-6, the heat exchange system 10 includes a first heat exchange assembly 50 (discussed in detail below) and a heat exchanger 300 that is disposed within an indoor environment 12. A wall or barrier 13 separates the indoor environment 12 from an outdoor environment 14. In some embodiments, the heat exchanger 300 is used to provide thermal conditioning to the indoor environment 12 while in other embodiments the heat exchanger 300 is used to cool or heat a certain aspect of the indoor environment, such as a liquid within the indoor environment (i.e. in applications where the heat exchanger 300 interacts with a liquid system that is selectively used to heat or cool systems within the environment.

The heat exchanger 50 is fluidly connected to the heat exchanger 300 and is configured to be operable in two different modes of operation using the established fluid connections within the system 10. Specifically, in a first mode of operation (depicted with arrows CC) the system 10 is operated to provide relatively cold refrigerant flow to the heat exchanger 300—such that the heat exchanger acts as an evaporator, while in the second mode of operation (depicted with arrows HH and pipes with flow drawn with broken lines next to them) the system 10 is operated to provide relatively hot refrigerant flow to the heat exchanger 300 such that the heat exchanger acts as a condenser. The system 10 may be configured to switch operation between the first and second modes of operation with the selective opening and closing of two or more isolation valves (which when shut prevent flow past the valve in both directions and when open allow flow past the valve in both directions), which when operated either prevent refrigerant from flowing through certain conduits within the system and allow refrigerant to flow through other conduits within the system, with the valves when positioned in some alternate positions (i.e. from shut to open or vice versa) allow refrigerant to flow through still other conduits in the system as discussed herein. The positioning of various valves results a cooling mode the refrigerant flowing through the first expansion valve 122 that is positioned proximate to a second manifold 300*b* of the heat exchanger 300 (and within the indoor space 12) so that refrigerant flows directly from the first expansion valve 122 and into the heat exchanger 300 (to provide a cooling effect in the heat exchanger 300).

When valves are in differing positions, refrigerant does not flow through the first expansion valve 122, but instead flows through the second expansion valve 124. The second expansion valve 124 is positioned within a flow path that directs refrigerant flow leaving a second set of tubes 80 of the heat exchanger 50 (discussed with respect to the heat exchanger 50, below) to flow through the second expansion valve 124 and then flow into the first set of tubes 60. In this embodiment, the refrigerant flow that ultimately reaches the indoor heat exchanger 300 is relatively hot to provide a heating effect produced by the heat exchanger 300 (and condensing effect of the refrigerant flowing through the system). These two different flow paths, and the operation of various valves in order to result in these flow paths is discussed in further detail below.

Figure 2:
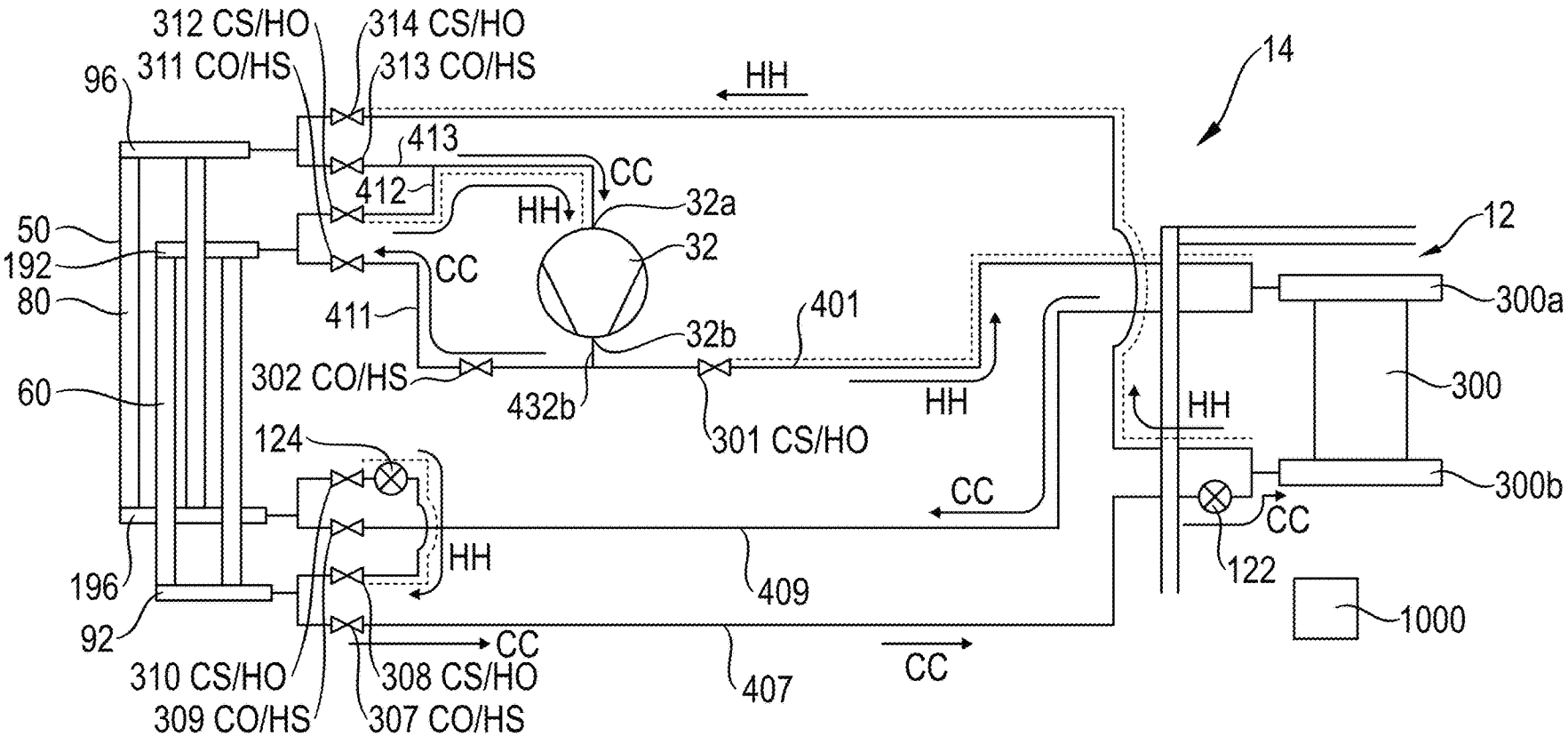
FIG. 2 is a schematic flow diagram of a first embodiment of the system to selectively cool or heat a heat exchanger within an indoor environment.

FIG. 2 provides a detail view of one embodiment of the system that includes isolation valves at every junction between the heat exchanger 50 and the remaining system, but does not include isolation valves at the junctions with the first and second manifolds 300*a*, 300*b* of the heat exchanger 300. The figure includes the valve positions of each isolation valve that is provided during the first mode of operation (cooling mode from the heat exchanger 300) labeled with letter "C" for each valve and labeled as either the valve being either open "O" or shut "S" in order to allow for flow as desired in the first/cooling mode. The flow path through the system in the cooling mode is depicted with arrows with the letters CC.

FIG. 2 also provides the valve positions when the system is operated in the second mode of operation (heating mode from the heat exchanger 300) labeled with the letter "H" for each valve and labeled as either the valve being either open "O" or shut "S" in order to allow for flow as desired in the second/heating mode. The flow path through the system in the heating mode is depicted with arrows with the letters HH and the piping that is used is annotated with a broken line next to the piping (e.g. a broken line is shown in piping from one of the two compressor outlet isolation valves 301 to the first manifold 300*a* of the heat exchanger 300). The figure schematically depicts a single pipe leaving each of the manifolds on the heat exchanger 50 and branching into two pipe legs from the single pipe. It should be understood that the manifolds of the heat exchanger 50 can alternatively be formed with two outlets, one each for the branches that connect to the isolation valves within the pipes that connect with each manifold—i.e. for example, regarding the first manifold (92) the system may be formed with the branch that includes valve 307 (within pipe line 407) to connect directly to the manifold and the branch that includes valve 308 (within pipe 408) to connect directly to the manifold.

The first manifold 92, which is connected to the plurality of first tubes 60, is fluidly connected with the first expansion valve 122 through pipe 407 with valve 307 therebetween. The first manifold 92 is also connected to the outlet of the second expansion valve 124 through pipe 408 with valve 308 connected therebetween.

The second manifold 192, which is connected to opposite ends of the plurality of first tubes 60 is fluidly connected with an outlet 32*b* of the compressor 32 via pipe 411 with isolation valve 311 (and in some embodiments also or instead valve 302) connected therebetween. The second manifold 192 is also connected to the inlet 32*a* of the compressor through pipe 412 with valve 312 disposed therein. A portion of the pipe 412 is the same pipe as pipe 413 discussed below.

The third manifold 196 is connected to one end of the plurality of second tubes 80, and is fluidly connected to the first manifold 300*a* of the heat exchanger 300 via a pipe 409 with isolation valve 309 disposed therebetween. The third manifold 196 is additionally connected to an inlet of the second expansion valve 124 through a pipe 410 with isolation valve 310 therebetween.

The fourth manifold 96 is connected to an opposite end of the plurality of second tubes 80, and is fluidly connected to the second manifold 300*b* of the heat exchanger 300 through pipe 414 with isolation valve 314 disposed therebetween. The fourth manifold 96 is additionally connected with the inlet 32*a* of the compressor through pipe 413 with the isolation valve 313 disposed therebetween.

In this embodiment, the first and second manifolds 300*a*, 300*b* of the heat exchanger 300 do not include isolation valves proximate to the manifolds 300*a*, 300*b* in the pipes (e.g. 414, 409) that connect to the manifolds. In this embodiment, flow is allowed through system in the paths and directions as schematically depicted in FIG. 2 based upon the existence of the valves 307-314 and the positions of valves 307-314 as discussed above. In one aspect of this embodiment, valve 301 is additionally provided in a pipe 401 that extends from the compressor outlet 32*b* (is a branch off of a single pipe 432*b* that extends from the compressor outlet 42*b* as schematically depicted in FIG. 2) to the first manifold 300*a* of the heat exchanger 300. The valve 301 is open in the second/heating mode to allow flow through the pipe 401 (as depicted by arrow HH in pipe 401), and is shut in the first/cooling mode to prevent flow through pipe 401 and cause all refrigerant leaving the compressor to flow through pipe 411 to the second manifold 192 and through the first set of tubes 60. In another aspect of this embodiment, the valve 301 may be positioned proximate to the first manifold 300*a* of the heat exchanger 300 instead of proximate to the compressor outlet 32*b* as depicted in FIG. 2.

Figure 3:
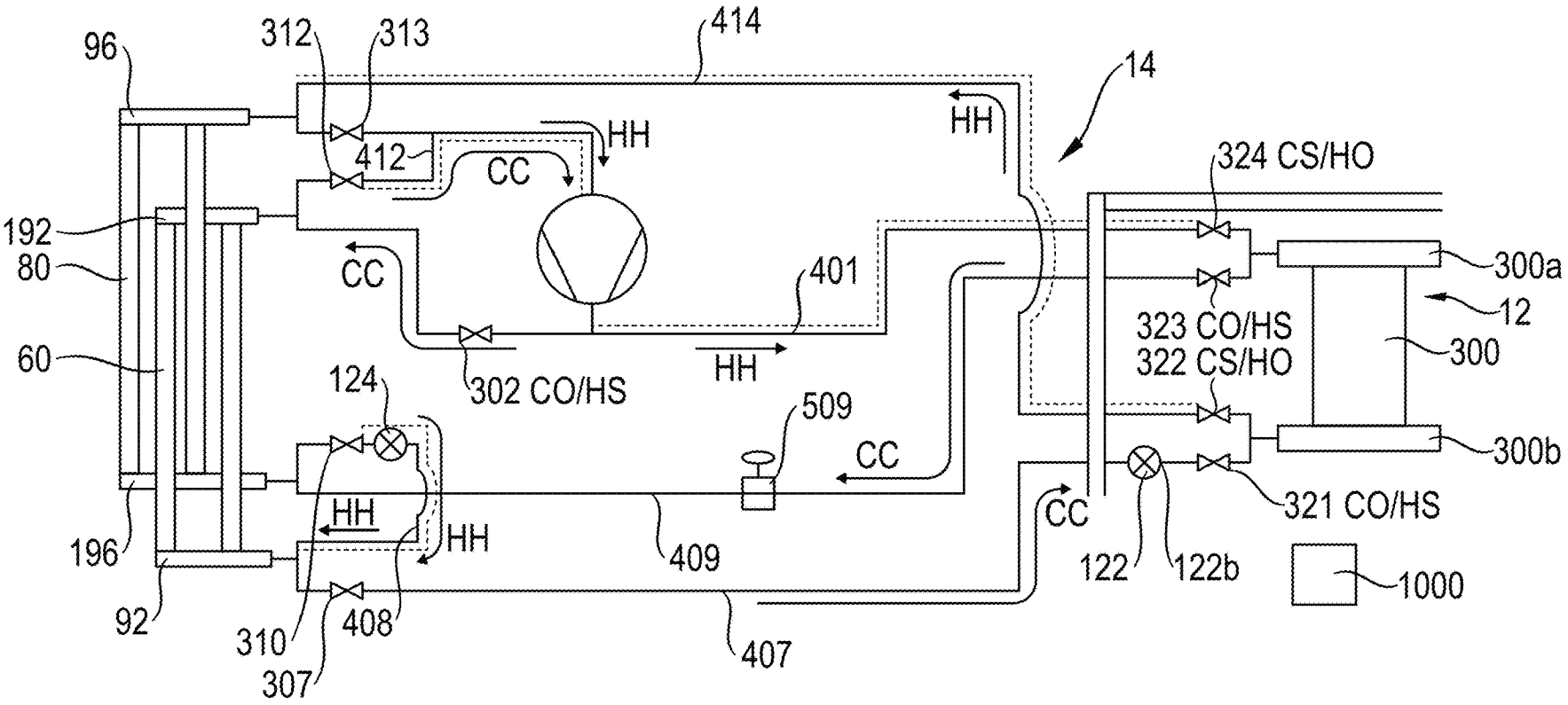
FIG. 3 is another schematic flow diagram of a first embodiment of the system to selectively cool or heat a heat exchanger within an indoor environment.

Turning now to FIG. 3, an alternate embodiment may be provided that includes isolation valves at every junction with the first and second manifolds 300*a*, 300*b* between the heat exchanger 300 (i.e. the indoor heat exchanger) and the remaining system, but does not include—in some embodiments any, or in all embodiments some—isolation valves that the junctions with the manifolds associated with the heat exchanger 50. The figure includes the valve positions of each isolation valve that is provided during the first mode of operation (cooling mode from the heat exchanger 300) labeled with letter "C" for each valve and labeled as either the valve being either open "O" or shut "S" in order to allow for flow as desired in the first/cooling mode. The flow path through the system in the heating mode is depicted with arrows with the letters CC.

FIG. 3 also provides the valve positions when the system is operated in the second mode of operation (heating mode from the heat exchanger 300) labeled with the letter "H" for each valve and labeled as either the valve being either open "O" or shut "S" in order to allow for flow as desired in the second/heating mode. The flow path through the system in the heating mode is depicted with arrows with the letters HH and the piping that is used is annotated with a broken line next to the piping (e.g. a broken line is shown in piping from one of the two compressor outlet isolation valves 301 to the first manifold 300*a* of the heat exchanger 300). The figure schematically depicts a single pipe leaving each of the first and second manifolds 300*a*, 300*b* and branching into two pipe legs from the single pipe. It should be understood that first and second manifolds 300*a*, 300*b* can alternatively be formed with two outlets, one each for the branches that connect to the isolation valves within the pipes that connect with each manifold—i.e. for example, regarding first manifold 300*a* system may be formed with the branch that includes 324 (within pipe line 401) to connect directly to the manifold and the branch that includes valve 323 (within pipe 409) to connect directly to the manifold.

The first manifold 300*a* of the heat exchanger 300 is connected with the outlet 32*b* of the compressor 32 through pipe 401 with an isolation valve 324 disposed therebetween. The isolation valve 324 is depicted in FIG. 3 as being proximate to the first manifold 300*a*, while in other embodiments, the valve 301 (FIG. 2) which is proximate to the compressor outlet 32*b* instead of or in addition to the isolation valve 324. The first manifold 300*a* is additionally connected to the third manifold 196 (connected to the plurality of second tubes 80) via pipe 409 with an isolation valve 323 disposed proximate to the first manifold.

The second manifold 300*b* of the heat exchanger 300 is connected with the outlet 122*b* of the first expansion valve with an isolation valve 321 therebetween. The second manifold 300*b* is further connected with the fourth manifold 96 (connected to the first plurality of tubes 80) via pipe 414 with an isolation valve 322 disposed therebetween and proximate to the second manifold 300*b*.

In some embodiments, the pipe 411 between the compressor outlet 32*b* and the second manifold 192 may include an isolation valve 302. This isolation valve is closed when in the second/heating mode to direct the compressed refrigerant only toward the first manifold 300*a* of the second heat exchanger 300, while the valve 302 is open when in the first/cooling mode to direct the compressed refrigerant toward the second manifold 192 to flow through the first set of tubes 60. In some aspects of this embodiment, an isolation valve 312 may be provided between the second manifold 192 and the compressor inlet 32*a*, which is shut during the first/cooling mode to prevent the compressed refrigerant from flowing back to the compressor inlet 32*a* instead of to the second manifold 192 and the first set of tubes 60.

In some aspects the system may include (as depicted in FIG. 3) to also include isolation valve 310 in the pipe between the third manifold 196 and the inlet of the second expansion valve 124, which when shut prevents refrigerant flowing from the first manifold 300*a* of the heat exchanger 300 through pipe 409 (first/cooling mode) from flowing into the second expansion valve 124 instead of into the third manifold. In this embodiment, the system may be further modified to include the isolation valve 307 in pipe 407 (that is shut in the second/heating mode) to prevent refrigerant flow from the second expansion valve 124 from flowing through pipe 407 toward the first expansion valve instead of flowing into the first manifold 92. In other embodiments, the valve 307 may be provided but the isolation valve 310 not provided.

Figure 4:
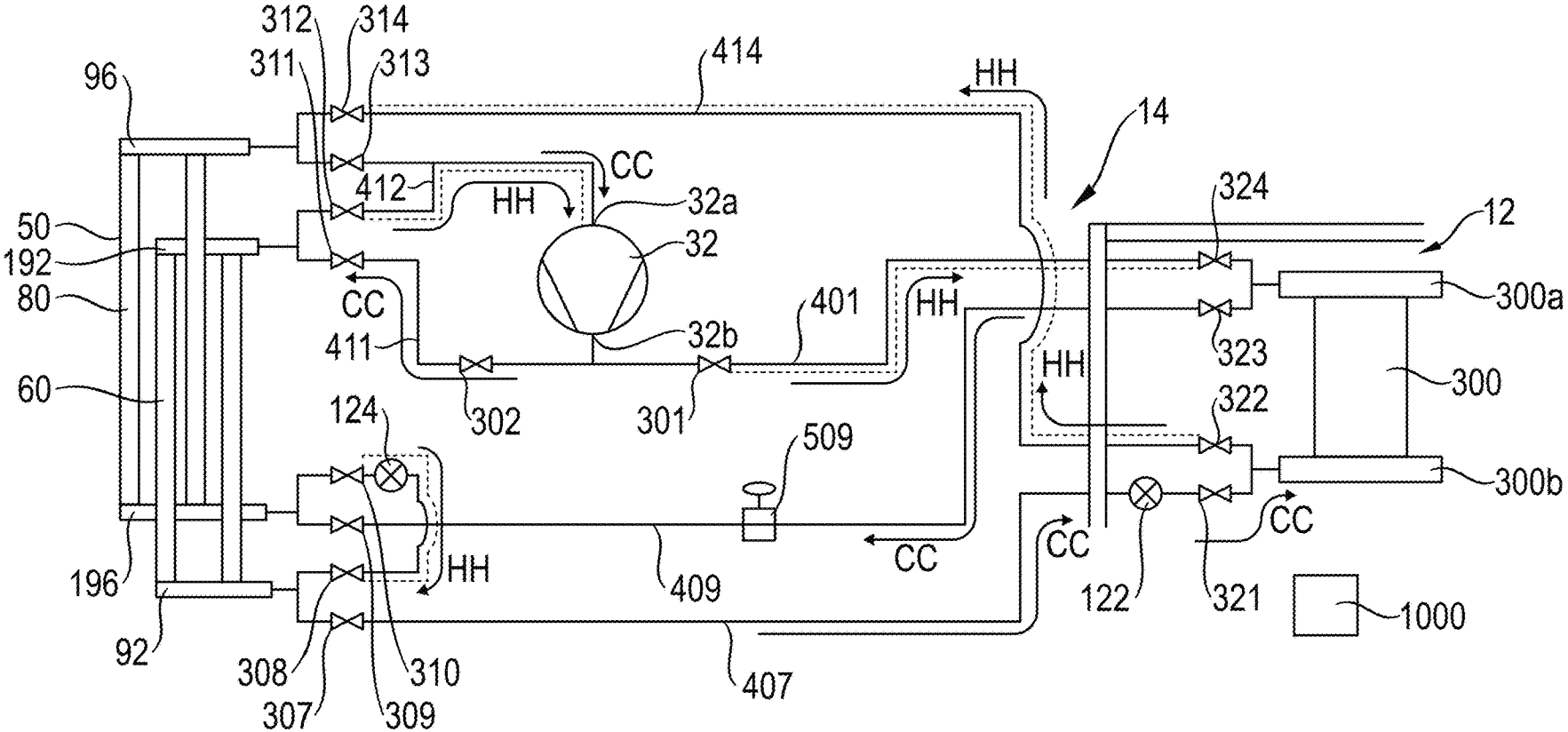
FIG. 4 is yet another schematic flow diagram of a first embodiment of the system to selectively cool or heat a heat exchanger within an indoor environment.

In another embodiment depicted in FIG. 4, the system may be configured with each of the eight isolation valves in the pipes to/from the first through fourth manifolds of the heat exchanger 50 (307-314) and the four isolation valves (321-324) in the pipes to/from the first and second manifolds 300*a*, 300*b* of the heat exchanger 300. In this embodiment there would be several sections of pipe e.g. 409 between valves 309 and 323 that could be isolated if both valves were shut (although shutting both valves 309 and 323 would be contrary to the correct valve positions in both the first and second modes of operation). In this embodiment, relief valves (such as 509, schematic) may be provided within the sections of pipe (e.g. 409) that could be isolated, to provide overpressure protection such as in situations where a valve position is misplaced or a valve is stuck shut (or actually shut but providing a valve position indication (i.e. to the controller 1000, discussed below) that it is open. The reliefs (e.g. 509) when provided would port to a low pressure section of the system in the events that they lift to provide over-pressure protection.

The embodiment of FIG. 4 depicts isolation valves 301 and 302 being provided, with 301 being in series with valve 324 and valve 302 being in series with valve 311. Only one of valves 301/324 need be provided and only one of valves 302/311 need be provided to fully direct flow in the proper directions (i.e. HH or CC) as depicted in the figure. One of ordinary skill in the art will readily appreciate that providing valves close to the source of flow in each mode will avoid having long pipes full of stagnant refrigerant due to no or very low flow occurring directly downstream of the valve. For example in the cooling mode, the inclusion of valve 301, which is proximate to the compressor outlet 32, which is shut in cooling mode would prevent the long length of pipe 401 (if valve 301 wasn't provided and shut) from being interacted by the high pressure refrigerant leaving the compressor and the inclusion of shut valve 301 (during the cooling operations) avoids this large pressurized pipe until reaching valve 323 proximate to the first manifold 300*a* of the heat exchanger 300.

Figure 5:
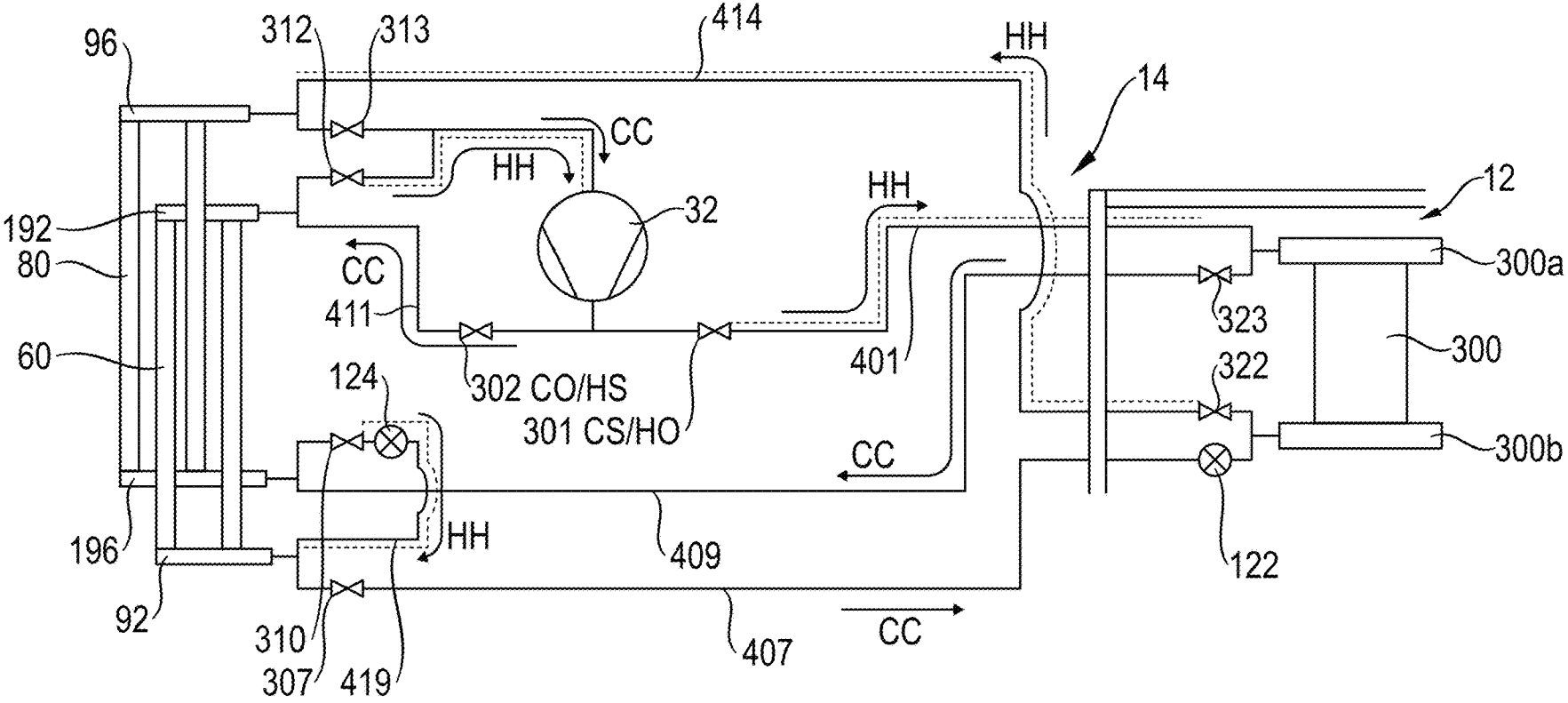
FIG. 5 is yet another schematic flow diagram of a first embodiment of the system to selectively cool or heat a heat exchanger within an indoor environment.
Figure 6:
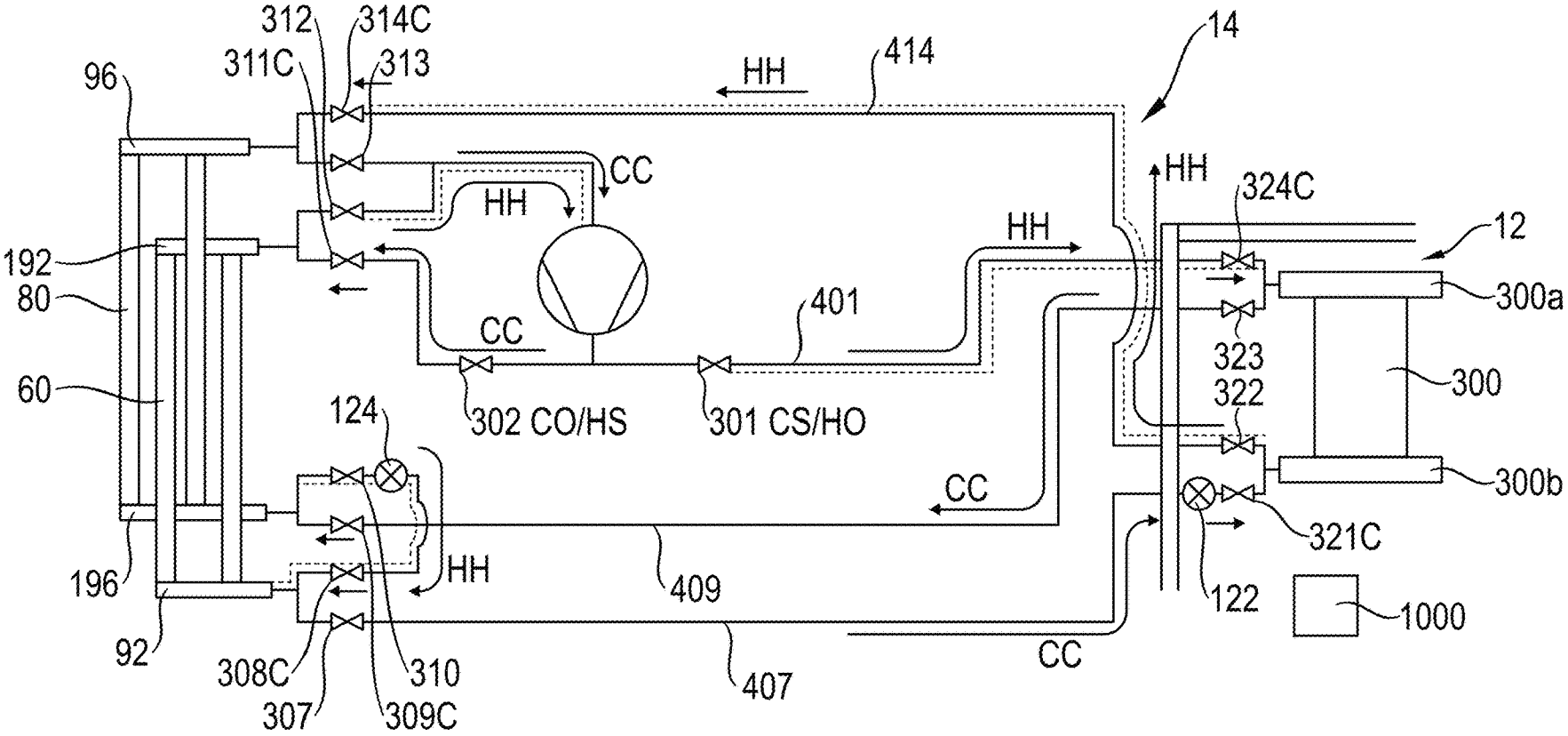
FIG. 6 is yet another schematic flow diagram of a first embodiment of the system to selectively cool or heat a heat exchanger within an indoor environment.

In still other embodiments, fewer of the total number of valves depicted in FIGS. 2-4 may be provided. In one representative embodiment depicted in FIG. 5, valves 301 and 302—both valves capable of isolating the pipes downstream of the compressor outlet 32*b*—are provided, with valve 301 open and valve 302 shut during the second (heating) mode of operation and the, and valve 301 shut and valve 302 open during the first (cooling) mode of operation. In FIG. 5 valves 312 and 313 are provided to control the flow into the compressor 32. In each of the embodiments depicted in FIGS. 2-6, valves 312 and 313 are needed and beneficial to control the flow path into the compressor 32, these valves (as well as 301/302) are the minimum number of valves that are needed for proper operation and for aligning the system for either cooling or heating of the inside 12. In the embodiment of FIG. 5, one isolation valve per leg of pipe 407, 419, 409, 414 is provided, such as valves 307, 322, 310, and 323 which are each positioned close to the respective heat exchanger 50/300 from which flow extends into the respective pipe during each mode of operation. In a related embodiment depicted in FIG. 6, the valves of FIG. 5 are provided, and check valves 321C, 308C, 309C, and 314C are provided (with the arrow associated with each valve depicting the flow direction that is allowed through the check valve) to isolate the line of pipe close to the heat exchanger 50/300 from which the flow does not emanate through the pipe (407, 419, 409, 414) during normal operation. In some embodiments check valves 311*c* and 324*c* may also be provided for a similar purpose. The embodiments of FIGS. 5 and 6 are provided to minimize the number of automatically controllable valves that are provided but allow for proper operation. By way of example, valves 301, 302 are provided to prevent the high pressure refrigerant leaving the compressor (pipes 401, 411, in hot and cool operations, respectively) from short circuiting the heat exchanger 300 (second/hot operations) and the tubes 60 (first/cool operations). The isolation valves discussed herein (e.g. 307, 308, 309, 310, etc.) are provided to only allow flow through pipes

407, 419, 409, 414, 401, 411 in the desired direction for the mode of operation, while avoiding stagnant legs of piping that are open in the system. Other embodiments may be provided where additional valves of the valves discussed above may be provided (but not all of the valves as in FIG. 4) are provided.

Figure 7:
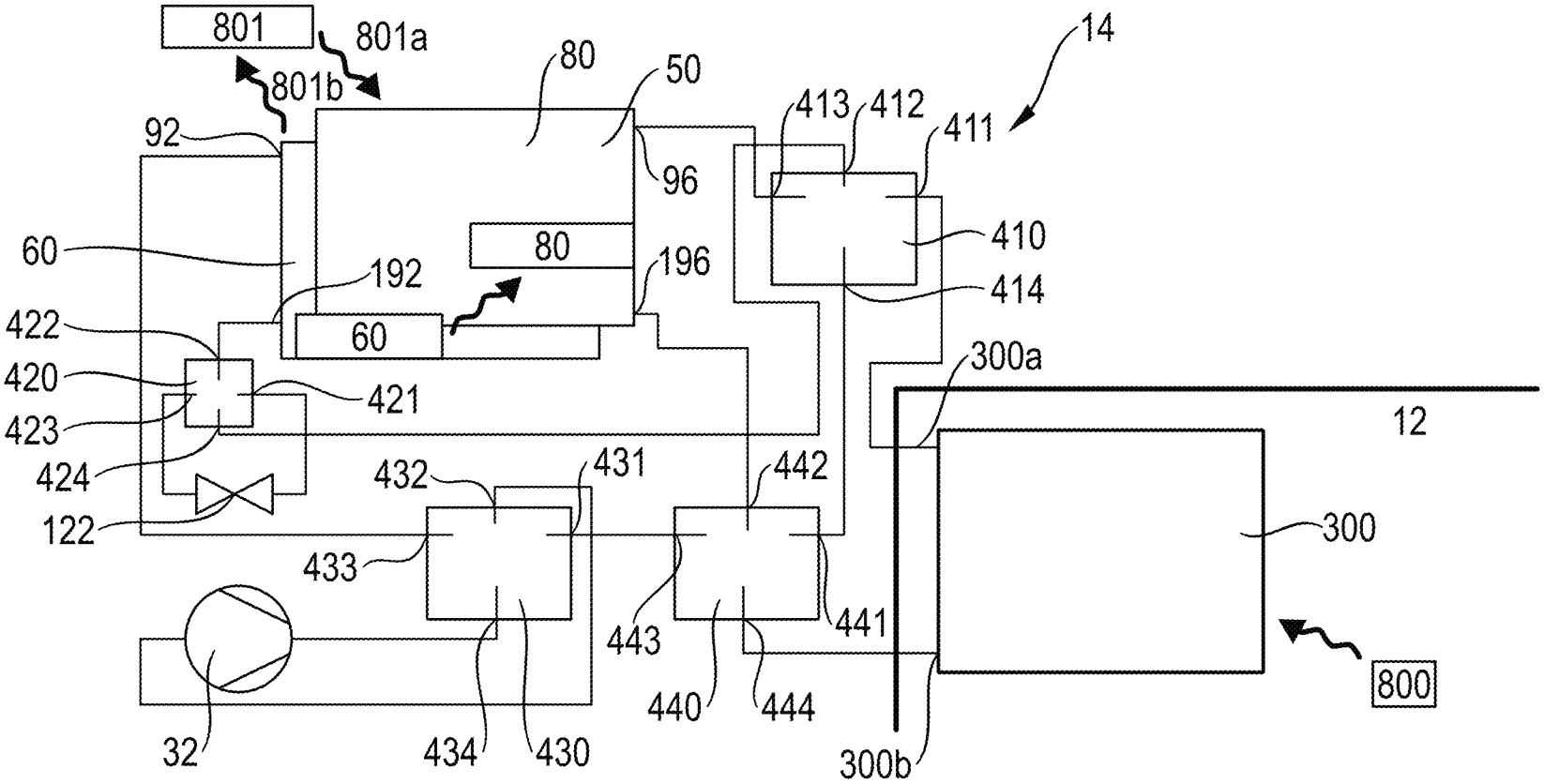
FIG. 7 is a schematic flow diagram of another system that is operating in cooling mode.
Figure 8:
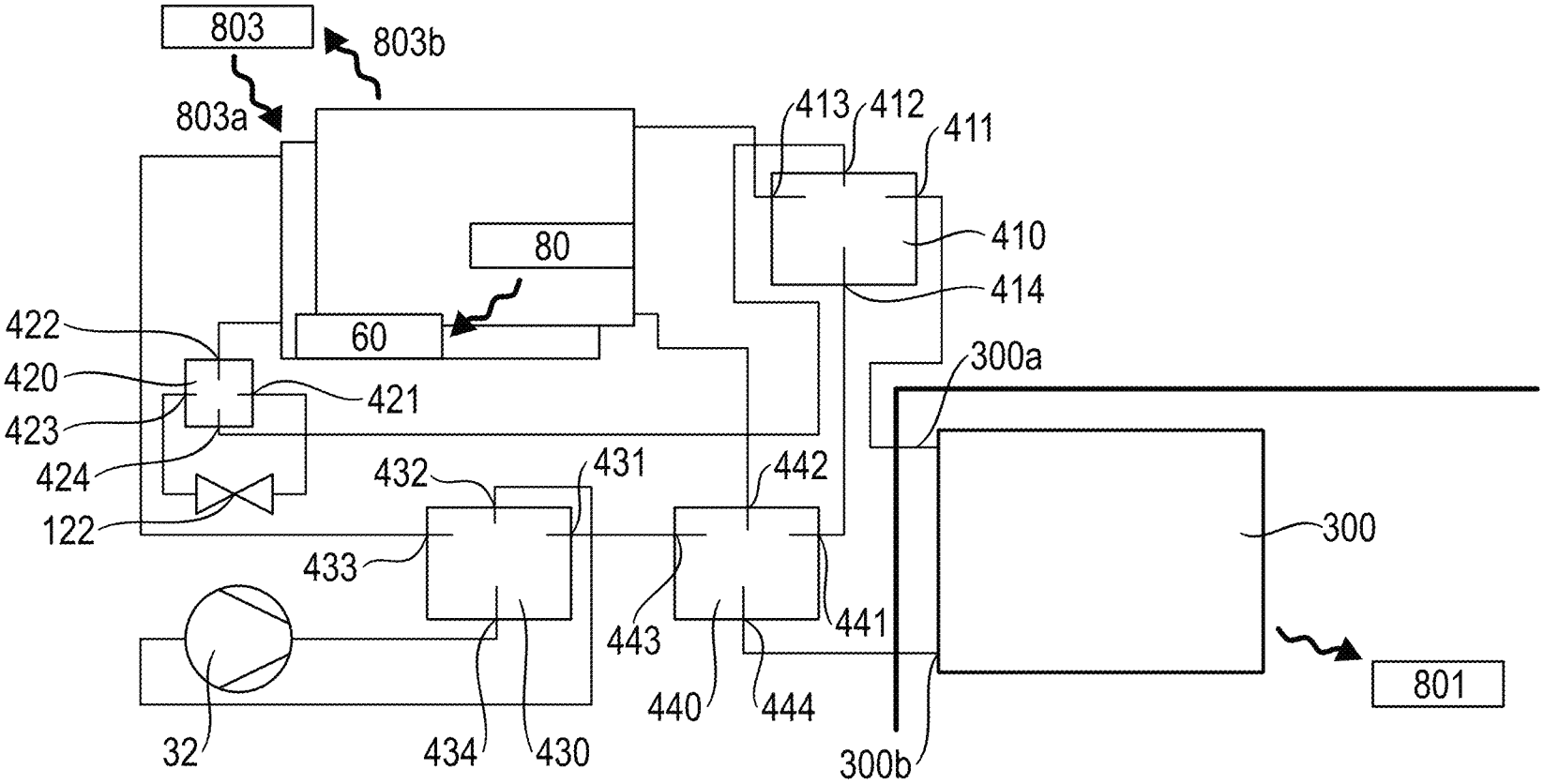
FIG. 8 a schematic flow diagram of the system of FIG. 7 where the system is operating in heating mode.

In FIGS. 7 and 8 an alternate embodiment of the system is provided where several four way valves are provided that can be aligned in different configurations to allow for the flow as desired in either the cooling mode (FIG. 7) or the heating mode (FIG. 8). While this embodiment includes providing four four-way valves (410, 420, 430, 440) that each have four discrete ports that are capable of being an inflow or an outflow port. The four way valves can be rearranged (either manually or automatically via a remote signal, such as from a controller) to change the flow paths into and out of each four way valve. FIG. 7 depicts a schematic exemplary system that is configured for the second heat exchanger 300 to provide cooling (either for the environment (indoor in 12 in this embodiment)—as schematically depicted with the arrow 800 showing the direction of heat flow of the air within the environment or in other embodiments an object proximate to the second heat exchanger 300 or to a liquid that flows through or past the second heat exchanger 300. FIG. 8 depicts the system of FIG. 7 arranged for a different flow path to allow the second heat exchanger to provide heat to the environment 12 (as schematically depicted with the arrow 801 showing the direction of heat flow.

The embodiment of FIGS. 7 and 8 operate with the same way as the embodiments of FIGS. 1*a*-6 depicted above and the discussion about the mode of operation of the first heat exchanger 50 and the second heat exchanger 300 from the above embodiments are equally applicable to the embodiment of FIGS. 7 and 8. The piping and the various four-way valves 410, 420, 430, 440 are arranged such that the in the cooling mode the refrigerant enters the second heat exchanger via manifold 300*b* and leaves the second heat exchanger 300 via manifold 300*a*, while in the heating mode refrigerant enters the second heat exchanger 300 via the manifold 300*a* and leaves the second heat exchanger 300 via the manifold 300*b*. One of ordinary skill in the art will appreciate that in other embodiments piping and the four-way valves can be arranged in other ways so that the refrigerant flow always flows through the second heat exchanger 300 in the same direction—e.g. always into the second heat exchanger 300 via the first manifold 300*a* and out via the second manifold 300*b*. One of ordinary skill in the art with a thorough review of this specification would be able to arrange the piping and the four way valves in a manner to allow for the constant flow direction through the second heat exchanger 300 with merely routine experimentation. In other embodiments, certain of valves and piped flow paths as depicted in one or more of FIGS. 2-6 may remain with others being replaced with one or more four-way valves as described herein. Alternatively, the system may include three-way valves or a combination of regular two way valves and three way valves, or a combination of two-way valves, three way, and four way valve. As discussed herein, one of ordinary skill with a review and understanding of this specification could modify the embodiments of FIGS. 2-6 to include one or more four way valves or one or more three-way valves and one or more four way valves. Similarly, the embodiments of FIGS. 7 and 8 could be modified to replace one or more four way valves with one or more two way valves and/or three way valves and the modifications to the refrigerant piping and modifications to the control system to manipulate the valves as needed for the desired operation (cooling or heating) would be well understood by one of ordinary skill in the art with a thorough review of this specification with only routine optimization.

The embodiment of FIGS. 7 and 8 may have many benefits such as the reduction of the number of pipes needed and therefore the reduction of the number of pipe connections. The design would eliminate the need for remotely operable valves other than the four four-way valves 410, 420, 430, 440 provided with the design. The embodiment would allow for the system to operate with only a single expansion valve 122.

The flow through system of FIGS. 7 and 8 in cooling mode is as follows: Refrigerant leaves the second heat exchanger 300 through the first manifold 300*a* and to the first four-way valve 410 (411). (The specific port that receives or emits flow is provided in parenthesis for the ease of understanding—but one of ordinary art will understand that the respective ports may change in systems that are actually constructed due to changes in the design of various four-way valves and how those four-way valves are arranged with respect to other components in the system (e.g. the first set of tubes 60, the second set of tubes 80, the expansion valve 122, the compressor 32, and the second heat exchanger 300)—and FIGS. 7 and 8 are purely schematic). Refrigerant leaves the first four-way valve 410 (413) and flows to the fourth manifold 96 of the second set of tubes 80. Refrigerant flowing through the second set of tubes 80 receives heat from the environment as shown schematically as 801*a*. Refrigerant flows out of the third manifold 196 and flows to the fourth four-way valve 440 (442) and then flows to the third four-way valve 430 (431). Refrigerant flows from the third four-way valve 430 (434) to the compressor 32 and then returns to the third four-way valve 430 (432). Refrigerant flows from the third four-way valve (433) to the first manifold 92 of the first set of tubes 60. Heat flows from the first set of tubes both to the refrigerant within the second set of tubes 80 as well as to the environment as shown schematically as 801*b*. Refrigerant flows from the second manifold 192 and to the second four-way valve (422) and then leaves the second four-way valve (424) to flow to the first four-way valve (412). Refrigerant leaves the first four-way valve (414) and flows to the fourth four-way valve (441) and then flows (444) to the second manifold 300*b* of the second heat exchanger.

The flow in heating mode (FIG. 8) is as follows: refrigerant leaves the second manifold 300*b* of the second heat exchanger 300 and flows to the fourth four-way valve (444) and flows from the fourth four-way valve 440 (442) to the third manifold 196 of the second set of tubes 80. Heat flows from the refrigerant flowing through the second set of tubes 80 to the environment as schematically shown as 803*b*. Refrigerant flows from the fourth manifold 96 to the first four-way valve 410 (413), and then flows from the first four-way valve 410 (412) to the second four-way valve 420 (424). Flow leaves the second four-way valve 420 (423) and flows through the expansion valve 122 and returns to the second four-way valve 420 (421). Refrigerant flows from the second four-way valve 420 (422) to the second manifold 192 and into the first set of tubes 60. Refrigerant flowing through the first set of tubes 60 receives heat from the environment (schematically 803*a*) as well as from refrigerant flowing through the second set of tubes 80. Refrigerant leaves the first set of tubes through the first manifold 92 and flows to the third four-way valve 430 (433). Flow leaves the third four-way valve 430 (434) and flows through the compressor 32 and then returns to the third four-way valve (432). Refrigerant leaves the third four-way valve (431) and flows to the fourth four-way valve (443), then it leaves (444) and flows to the first four-way valve (414). Flow leaves the first four-way valve (411) and flows to the first manifold 300*a* of the second heat exchanger 300.

Each of these systems may include a controller 1000, shown schematically in the figures. The controller 1000 provides signals directly or indirectly to each of the isolation valves discussed herein regarding the desired position of each isolation valve. In embodiments where the isolation valves are remotely operable, the controller 1000 provides signals to the isolation valves for those valves to be in the desired open or shut position depending upon the mode of operation of the system 10 (as discussed herein). The remotely operable valves may include a sensor that can identify that the valve set of the valve (not show) in in the desired position (to allow flow—open, or to prevent flow—shut), or the valves may be controlled to move the valve seat to the desired position (e.g. via a solenoid or other linear actuator or a motor, or the like).

The controller 1000 may also operate the compressor 32 as needed (duty cycle of the compressor and/or speed of the compressor) in order to provide the refrigerant flow and refrigerant temperature as needed through the heat exchanger 300 for the desired cooling warming effect from the heat exchanger 300. In some embodiment, the first and/or second expansion valves 122, 124 may be adjusted by the controller 1000 to change the throttling characteristics of the expansion valves to adjust the performance of the system in the respective cooling (valve 122) or heating (valve 124) scenarios.

The controller 1000 may communicate with a user—either via a hardwired or remote input device (communicating with a cellular, WiFi, Bluetooth, or other communication technologies) where the user provides instructions regarding the desired operation of the heat exchanger 300, i.e. whether the heat exchanger 300 should provide heat to the space/flowing output fluid (the second, heating mode) or remove heat from the space/flowing output fluid (the first, cooling mode) as well as the magnitude of heat provided or removed. The user may input this via desired temperature settings, or via a programmed schedule.

Alternatively or additionally, the controller 1000 may receive instructions from a remote source—such as a networked scheduling system that remotely provides instructions to the controller regarding operation of the heat exchanger 300. These remote instructions may or may not be able to be overridden by the user based upon agreements that the user may have in force with the entity that operates the networked scheduling system. In one embodiment, the networked scheduling system may be an electric utility (or an entity that contacts with the electric utility to control the amount of load that is used from the electric utility), with the utility (or contractual entity) being provided with the permission to control the operation of the heat exchanger 300 constantly, only at predetermined times, or only if certain thresholds within the utility are met (i.e. a situation where the utility's capacity is constrained due to decreased supply or increased demand). In another embodiment, the networked scheduling system may be a control system associated with a vehicle, where the heat exchanger 300 is associated with the climate control system of a vehicle. The vehicle's control system may be configured to be able to instruct the controller 1000 (or the controller 1000 may be a portion of the vehicle's overall control system) to operate the heat exchanger 300 in a certain manner to remove more heat from the engine, remove less heat from the engine, or limit or increase the operation (speed or duty cycle) of the compressor 32 to manage electrical power usage due to electrical power management concerns of the vehicle (such as in embodiments where the vehicle is powered from a battery to minimize electrical power usage of the HVAC system when total battery storage within the vehicle has dropped below a predetermined threshold—or as directed by a passenger within the vehicle).

The computing elements or functions disclosed, including the controller 1000 herein may include a processor and a memory storing computer-readable instructions executable by the processor. In some embodiments, the processor is a hardware processor configured to perform a predefined set of basic operations in response to receiving a corresponding basic instruction selected from a predefined native instruction set of codes. Each of the modules defined herein may include a corresponding set of machine codes selected from the native instruction set, and which may be stored in the memory. Embodiments can be implemented as a software product stored in a machine-readable medium (also referred to as a computer-readable medium, a processor-readable medium, or a computer usable medium having a computer-readable program code embodied therein). The machine-readable medium can be any suitable tangible medium, including magnetic, optical, or electrical storage medium including a diskette, optical disc, memory device (volatile or non-volatile), or similar storage mechanism. The machine-readable medium can contain various sets of instructions, code sequences, configuration information, or other data, which, when executed, cause a processor to perform steps in a method according to an embodiment of the invention. Those of ordinary skill in the art will appreciate that other instructions and operations necessary to implement the described embodiments can also be stored on the machine-readable medium. Software running from the machine-readable medium can interface with circuitry to perform the described tasks. Moreover, embodiments may be implemented on application specific integrated circuits (ASICs) or very large scale integrated (VLSI) circuits. In fact, persons of ordinary skill in the art may utilize any number of suitable structures capable of executing logical operations according to the embodiments.

The system 10, being a dual flow system with a first mode where the heat exchanger 300 operates to cool or remove heat from its environment or a fluid that flows through or past the heat exchanger, and a second mode where the heat exchanger 300 operates to provide heat to the environment or the fluid that flows through or past the heat exchanger 300.

In the first/cooling mode (CC arrows), the expansion valve 122 within the system is located within the indoor space and in some embodiments proximate to the heat exchanger 300. The flow through the system is as follows: low pressure vapor from the fourth manifold 96 of the second set of tubes 80 flows to the compressor 32, where it is pressurized into high pressure/high temperature vapor. The flow is directed thought pipe 411 toward the first set of tubes 60 (with valve 301, when provided—shut). The first set of tubes 60 that acts as a condenser, where the vapor rejects heat to the outside environment, thereby condensing the refrigerant to a liquid. The liquid leaves the first set of tubes 60 through the first manifold 92 and flows to the first expansion valve 122, which is located within the indoor space 12, where the refrigerant pressure is decreased resulting in a combination of vapor and liquid, which flows into the second manifold 300*b* of the indoor heat exchanger 300 acting as an evaporator. The refrigerant receives heat from the indoor environment (cross-flow or from the surface of the heat exchanger 300), which results in the refrigerant being mostly, but not completely, evaporated into vapor. The refrigerant leaves the heat exchanger 300 through the first manifold 300*a* and flows through pipe 409 to the third manifold 196, where it enters the second set of tubes 80. The second set of tubes 80 receives heat from the refrigerant flowing through the first set of tubes 60 (discussed above), such that the second set of tubes 80 acts as a super-heater of the refrigerant. The exterior environment also adds heat to the second set of tubes 80. The refrigerant then leaves the second set of tubes 80 through the fourth manifold 96 as super-heated vapor and is directed to the inlet of the compressor where the cycle discussed above runs again. This configuration is beneficial, in that the second set of tubes 80 with the heat exchanger 50 acts as a super-heater. This allows the controller throttle the first expansion valve 122 open further than would have been possible without this feature—such that less super heating (or even no super heating) needs to occur within the heat exchanger 300, thereby improving the performance of the heat exchanger 300. This configuration is also beneficial in that the heat moving from the tubes 60 in the heat exchanger 50 to the tubes 80 increases the condensing performance of the tubes 60 which increases the efficiency of the system.

In the heating second/heating mode (broken lines associated with flow—HH arrows) the expansion valve within the system 124 is located in the outdoor (or un temperature regulated) space and preferably proximate to the heat exchanger 50. The flow through the system is as follows: low pressure vapor from the second manifold 192 of the first set of tubes 60 flows to the compressor 32, and high pressure/high temperature vapor flows to the first manifold 300*a* of the indoor heat exchanger through pipe 401. When provided valve 302 (within pipe 411 leading to the second manifold 192) is shut. The vapor entering the heat exchanger 300 provides heat to the indoor environment or the fluid flowing through or past the heat exchanger, which causes the heat exchanger to act as a condenser, thereby causing the refrigerant to become mostly liquid. The liquid flows from the second manifold 300*b* of the heat exchanger 300 through pipe 414 to the fourth manifold 96 where the high pressure liquid flows through the second set of tubes 80. The second set of tubes 80 releases heat to either the environment and/or the first set of tubes 60 thereby completing the condensing and lowering the temperature of the refrigerant liquid. Refrigerant leaves the second set of tubes 80 through the third manifold 196 and flows to the second expansion valve 124. The expansion valve reduces the pressure within the liquid thereby causing the refrigerant to become at least part vapor and decreasing the temperature of the refrigerant. After passing through the expansion valve 124, the refrigerant flows into the first set of tubes 60 via the first manifold 92, where the low pressure vapor (or vapor and liquid mix) gains heat from the refrigerant passing through the second set of tubes 80) causing the refrigerant to become entirely vapor. The refrigerant flows out of the second manifold 192 and to the compressor where the cycle continues.

Turning now to FIG. 1, a multiple tube heat exchanger system 50 is provided that can be used within an overall heat exchange system 10. The heat exchanger 50 is usable in various heating and cooling scenarios. For example, the heat exchanger 50 is configured to be operable in two different configurations, a first where the heat exchanger 300 in an indoor environment provides cooling to the indoor environment (either by cooling a fluid that flows through the heat exchanger, or by cooling a space within the indoor environment) and a second where the heat exchanger 300 in the indoor environment provides heat to the indoor environment (either by heating a fluid that flows through the heat exchanger, or by heating a space within the indoor environment. The system 10 therefore operates with the indoor heat exchanger operating as an evaporator when it is to provide cooling and a condenser when it is to provide heating.

The heat exchanger 50 includes a plurality of first tubes 60 and a plurality of second tubes 80. The plurality of first tubes 60 and the plurality of second tubes 80 are fluidly disposed such that, in some embodiments, as refrigerant fluid flows through the system 10, the refrigerant flows through each of the plurality of first tubes 60 and the plurality of second tubes 80 before flowing through a second heat exchanger or before flowing past the components that are desired to be thermally modified (i.e. heated or cooled) by the refrigerant. In some embodiments, the heat exchanger 50 can be used within a heat exchange system 10 that has two operational modes (i.e. either to supply heat to the heat exchanger 300 or to remove heat from a heat exchanger 300) the path of flow through the first and second tubes 60, 80 varies with operations of the system, as will be discussed below.

The plurality of first tubes 60 extend in the same direction and are disposed in a parallel and offset manner with respect to each other to extend from a first manifold 92 to a second manifold 192. The first tubes 60 are positioned with respect to each other such that the adjacent tubes within the first set of tubes establishes a space X therebetween along each tube between the first manifold 92 and the second manifold 192. Other aspects of the plurality of first tubes from each embodiment will be discussed in detail below.

The plurality of second tubes 80 all extend in the same direction and are disposed in a parallel and offset manner with respect to each other to extend from a third manifold 96 to a fourth manifold 196. The second tubes 80 are positioned with respect to each other such that the adjacent tubes within the second set of tubes establishes a space Y therebetween along each tube between the third manifold 96 and the fourth manifold 98. A central portion 81 (also referred to as the heat exchange portion) of each of the second tubes 80 are disposed within the space X between adjacent central portions 61 (heat exchange portions) of adjacent first tubes 60. Wherein "each" tube as used herein with respect to both the first set of tubes 60 and the second set of tubes 80 is specifically defined herein to mean all of the respective tubes with the possible exception of the tube(s) 60 and/or tube(s) 80 that is the most outboard of the plurality of tubes, and establishes an outer tube within the heat exchange assembly. One of ordinary skill in the art will understand that for the two tubes that establish the outer tube within the heat exchange assembly, there will be no tubes that extend adjacent to that tube on the outer side of that tube and therefore the central portion of the outer tubes do not extend within a space between adjacent tubes of the other set of tubes. The term "each" includes all tubes that extend between two tubes of the opposite sets of tubes, and to include the two tubes that establish the outer-most tube of the heating assembly, which are adjacent to the central portion of a tube from the other set of tubes.

The heat exchanger 50 is aligned within a HVAC system, a heating system, or a cooling system as discussed herein. The heat exchanger 50 allows for two flows of fluid, a first flow simultaneously through the plurality of first tubes 60 and a second flow simultaneously though the plurality of second tubes 80. The heat exchanger 50 may be plumbed with respect to the HVAC, a heating system, or cooling system in various different scenarios, as discussed herein, so that flow through both the first and second sets of tubes are each in the general direction D, both in the general direction E or that a flow through the plurality of first tubes 60 is in the direction D and the flow through the plurality of second tubes is in the direction E. The heat exchanger 50 may be used with a forced air or fluid flow across the tubes and the fins 58 that are connected to the tubes or with other heat transfer methods as known in the art. In some embodiments, each of the plurality of first tubes 60 and the plurality of second tubes 80 may support a plurality of fins that extend outward therefrom. The fins 58 that extend from the plurality of first tubes 60 may contact a surface of an adjacent tube from the second plurality of tubes 80 and the fins that extend from the second plurality of tubes 80 may contact a surface of an adjacent tube from the first plurality of tubes 60. Alternatively, some fins 58 may be connected adjacent tubes from the first and second pluralities 60, 80. In still other embodiments, fins 58 that extend from tubes of the first plurality 60 may connect to tubes 58 that extend from the second plurality of tubes 80, with connections configured to enhance heat flow through the connections through welding or via other methods known in the ar.

The tubes 60 and 80 may be formed with different geometries and different cross-sections. In some embodiments, the tubes 60 and 80 are made to be mirror images of each other, such that, for example, a bent portion of tube 60 begins bending in a direction with a left vector component and has a later portion of the tube that bends with a right vector component, while the bent portion of the tube 80 begins bending in a direction with a right vector component and a later portion of the tube that bends with a left vector component. Other than the opposite bending directions of the first and second tubes, the tubes are the same—with the extended end portions extending in the same direction (i.e. an upper vector component) for both tubes, and the curvature of the bending portions of each of the first and second tubes being substantially mirror images of each other with a mirror plane vertical and through the longitudinal axis of the straight central portion of each tube (i.e. parallel to the wide surfaces of the straight portion of each tube). In some embodiments, the tubes are formed with outer walls that establish a single lumen, while tubes may alternatively be formed with a plurality of separate parallel flow lumens. The term substantially includes exactly the same as well as minor differences in bending the tubes due to reasonable tolerances that are typical in the art of bending long tubes—such as tolerances of up to plus or minus 5 degrees of tolerance of a bending angle (on either side of the nominal bending angle), up to plus or minus of several millimeters of difference in radial length or arc length on curvatures from the nominal, and up to plus or minus several millimeters of differences in bends begin or end from a nominal position where a bend is designed to begin or end upon the length of each tube.

The tubes 60, 80 are preferably made from metal, although other materials that have high thermal conductivity. The tubes may be constructed from a uniform material along the entire cross-section and length of the tube, while in other embodiments, the tube could be constructed from several layers, such as an inner layer of more flexible material (with a relatively high thermal conductivity) but that is flexible enough to be bent into the desired shape of the transition region 61*a*, 81 as discussed below without resulting in crimping or significantly blocking the lumens x, while another material provided outboard with a higher thermal conductivity and potentially with other benefits (weight, cost benefits over the inner flexible material). The tubes 60, 80 may be constructed by extrusion, or machining, or by bending planar pieces into shape to form the desired cross-sectional geometry and then bent in the geometry and shape along the length of the tubes.

The term "about" is specifically defined herein to include a range that includes the reference value and plus or minus 5% of the reference value. The term "substantially the same" is satisfied when the width of the end surfaces of the holes are both within the above range.

While the preferred embodiments of the disclosed have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

The specification as contemplated by the applicant can be best understood with reference to the following representative paragraphs:

Representative Paragraph 1: A Heat exchanger system (10) comprising:

a first heat exchanger assembly (50)
a compressor (32)
a second heat exchange assembly (300)
an expansion valve (122)
within the first heat exchanger assembly (50) is configured to be disposed in an outdoor space
within the second heat exchanger assembly (300) is configured to be disposed in an indoor space
wherein the second heat exchanger assembly (300) comprises first and second manifolds
within a refrigerant flows through the first heat exchanger assembly (50), the compressor (32), the second heat exchange assembly (300) and the expansion valve (122, 124)

characterized in that the first heat exchanger assembly (50) comprising a first set of tubes (60) that are arranged in a parallel flow manner between a first manifold (92) and a second manifold (192), wherein straight portions of adjacent tubes within the first set of tubes (60) are disposed with a space therebetween along each tube of the first set of tubes (60) between the first manifold (92) and second manifolds (192), within the first heat exchanger assembly (50) comprising a second set of tubes (80) that are arranged in a parallel flow manner between a third manifold (96) and a fourth manifold (196), wherein straight portions of adjacent tubes within the second set of tubes (80) are at least partially disposed within the space between straight portions of adjacent tubes of the first set of tubes (60), wherein the refrigerant that flows through the first set of tubes (60) additionally flows through the second set of tubes (80) before the refrigerant returns to again flow through the first set of tubes (60), wherein the first and second manifolds of the second heat exchanger assembly (300) that are disposed at opposite ends of one or more flow paths that are fluidly connected with both of the first set of tubes (60) and the second set of tubes (80).

Representative Paragraph 2: Heat exchanger system (10) of Representative Paragraph 1, characterized in that the first heat exchanger assembly (50) comprising fins (58) arranged between the tubes of the two set of tubes (80, 60), within the fins (58) are loaded with air, such that heat can be exchanged between the air and the refrigerant, within heat can be exchanged between the refrigerant in the first set of tubes (60) and the refrigerant in the second set of tubes (80).

Representative Paragraph 3: Heat exchanger system (10) of Representative Paragraph 2, characterized in that the refrigerant that flows through the compressor (32) reaches the compressor after flowing through the second set of tubes (80) and upon leaving a compressor (32) outlet flows through the first set of tubes (60).

Representative Paragraph 4: Heat exchanger system (900) of Representative Paragraph 2, characterized in that the refrigerant that flows through the compressor (32) reaches the compressor (32) after flowing through the first set of tubes (60) and upon leaving the compressor (32) outlet flows through the second heat exchanger (300) before flowing through the second set of tubes (80).

Representative Paragraph 5: Heat exchanger system (10) of Representative Paragraph 3, characterized in that the first set of tubes (60) is a condenser and the second set of tubes (80) is a superheater, within the second heat exchange assembly (300) is an evaporator.

Representative Paragraph 6: Heat exchanger system (10) of Representative Paragraph 4, characterized in that the first set of tubes (60) is an evaporator and the second set of tubes (80) is a subcooler, within the second heat exchange assembly (300) is a condenser.

Representative Paragraph 7: The first heat exchanger assembly (50) within the heat exchanger system (10) of Representative Paragraph 3 or 4, characterized in that the each of the tubes of the first set of tubes (60) are formed with the same geometry and size and each of the tubes within the second set of tubes (80) are formed with the same geometry and size.

Representative Paragraph 8: The first heat exchanger assembly (1) within the heat exchange system (10) of Representative Paragraph 7, characterized in that each of the tubes within the first set of tubes (60) includes the straight portion along their length and a curved portion along their length, wherein the straight portion of each of the tubes within the first set of tubes (60) is fixed to the first manifold (92) and the curved portion of each of the tubes within the first set of tubes (60) is fixed to the second manifold (192), and wherein each of the tubes within the second set of tubes (80) includes the straight portion along their length and a curved portion along their length, wherein the curved portion of each of the tubes within the second set of tubes (80) is fixed to the third manifold (196) and the straight portion of each of the tubes within the second set of tubes (80) is fixed to the fourth manifold (96).

Representative Paragraph 9: The first heat exchanger assembly (50) within the heat exchange system (10) of Representative Paragraph 7 or 8, characterized in that the curved portion of each of the tubes of the second set (80) extend away from the straight portion with vector components in right or left directions that are opposite from a shape of the curved portion that extends from the straight portion in each of the tubes within the first set of tubes (60), the same relationship exists for each of the first set of tubes (60) having a curved portion extending away from the straight portion of the second set of tubes (80) on the opposite end of the heat exchanger Representative Paragraph 10: The first heat exchanger assembly (1) within the heat exchange system (10) of Representative Paragraph 7, 8 or 9, characterized in that the third manifold (196) is offset from the first manifold (92) such that a first line through a centerline of the first manifold (92) and through a centerline of the third manifold is disposed at an acute or perpendicular angle to a second line that extends between the centerline of the first manifold (92) and a centerline of the fourth manifold (96).

Representative Paragraph 11: The heat exchange system (10) of Representative Paragraph 7, 8, 9 or 10, characterized in that the heat exchange system (10) comprise at least four valves, within the at least vales are reversing valves and/or three way valves and/or four way valves.

Representative Paragraph 12: Method for operating a heat exchanger system (10) have at least one of the preceding Representative Paragraphs 1 to 11 with the steps

- Pass the refrigerant through the circulate of the Heat exchanger system (10)
- Heat and evaporate of the refrigerant in the second heat exchanger assembly (300)
- Further heat of the refrigerant and evaporation of the remaining liquid components of the refrigerant in the second set of tubes (80) of the first heat exchanger assembly (1)
- Pass the gaseous refrigerant exiting the second set of tubes (80) of the first heat exchanger assembly (50) to the compressor (32)
- Compressing the gaseous refrigerant in the compressor (32) so that the pressure of the gaseous refrigerant is increased
- Cooling and condensing of the gaseous refrigerant in the first heat exchanger assembly (1) in which the gaseous refrigerant is cooled to a saturation temperature and liquefied in the first set of tubes (60).
- Expansion of the liquid refrigerant in an expansion valve (122) so that the pressure of the liquid is reduced characterized in that the expansion valve (122) is opened so that only an insignificant small superheating of the refrigerant occurs in the second heat exchanger assembly (300), within the temperature of the second set of tubes (80) is lower than the temperature of the first set of tubes (60).

Representative Paragraph 13: Heating system or air conditioning system having at least one heat exchanger system (10) according to at least one of Representative Paragraphs 1-11.

Representative Paragraph 14. A heat exchange system comprising:

- a first heat exchange assembly that is configured to be disposed in an outdoor space configured for outside air to flow therethrough, the first heat exchange assembly comprising:
  - a first set of tubes that are arranged in a parallel flow manner between a first manifold and a second manifold, wherein straight portions of adjacent tubes within the first set of tubes are disposed with a space therebetween along each tube of the first set of tube between the first and second manifolds;
  - a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;
  - a second heat exchanger that is disposed within an interior space, wherein the second heat exchanger comprises first and second manifolds that are disposed at opposite ends of one or more flowpaths that are fluidly connected with both of the first set of tubes and the second set of tubes;

a compressor, and an expansion valve, wherein in a first mode of operation refrigerant that flows through the compressor reaches the compressor after flowing through the second set of tubes and upon leaving a compressor outlet flows through the first set of tubes, and wherein in a second mode of operation refrigerant that flows through the compressor reaches the compressor after flowing through the first set of tubes and upon leaving the compressor outlet flows through the second heat exchanger before flowing through the second set of tubes.

Representative Paragraph 14.1. A heat exchange system comprising:

a first heat exchange assembly that is configured to be disposed in an outdoor space configured for outside air to flow therethrough, the first heat exchange assembly comprising:

a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

a second heat exchanger that is disposed within an interior space, wherein the second heat exchanger comprises first and second manifolds that are disposed at opposite ends of one or more flowpaths that are fluidly connected with both of the first set of tubes and the second set of tubes;

a compressor, and an expansion valve, and wherein in a first mode of operation refrigerant that flows through the compressor reaches the compressor after flowing through the second set of tubes and upon leaving a compressor outlet flows through the first set of tubes.

Representative Paragraph 15: The heat exchange system of either of Representative Paragraph 14 or 14.1, wherein each of the tubes of the first set of tubes are formed with the same geometry and size and each of the tubes within the second set of tubes are formed with the same geometry and size.

Representative Paragraph 16: The heat exchange system of any one of Representative Paragraphs 14, 14.1, or 15, wherein each of the tubes within the first set of tubes includes the straight portion along their length and a curved portion along their length, wherein the straight portion of each of the tubes within the first set of tubes is fixed to the first manifold and the curved portion of each of the tubes within the first set of tubes is fixed to the second manifold, and wherein each of the tubes within the second set of tubes includes the straight portion along their length and a curved portion along their length, wherein the curved portion of each of the tubes within the second set of tubes is fixed to the third manifold and the straight portion of each of the tubes within the second set of tubes is fixed to the fourth manifold.

Representative Paragraph 17. The heat exchange system of Representative Paragraph 16, wherein the curved portion of each of the tubes of the second set extend away from the straight portion with vector components in right or left directions that are opposite from a shape of the curved portion that extends from the straight portion in each of the tubes within the first set of tubes, each of the first set of tubes also having a curved portion extending away from the straight portion of the second set of tubes with vector components in the left or right direction on the opposite end of the heat exchanger assembly.

Representative Paragraph 17.1. The heat exchange system of Representative Paragraph 16, wherein the curved portion of each of the tubes of the second set extend away from the straight portion with vector components in right and left directions that are opposite from a shape of the curved portion that extends from the straight portion in each of the tubes within the first set of tubes.

Representative Paragraph 18. The heat exchange system of any one of Representative Paragraphs 17 or 17.1, wherein the third manifold is offset from the first manifold such that a first line through a centerline of the first manifold and through a centerline of the third manifold is disposed at an acute or perpendicular angle to a second line that extends between the centerline of the first manifold and a centerline of the second manifold.

Representative Paragraph 19. The heat exchange system of any one of Representative Paragraphs 14, 14.1, 15-17, 17,1, and 18, wherein the expansion valve comprises first and second expansion valves, wherein the first expansion valve is disposed within the interior space, and the second expansion valve is disposed within the outdoor space, wherein the system is configured to only allow refrigerant flow through one of the first expansion valve in the first mode of operation, and the system is configured to only allow refrigerant to flow through the second expansion valve during the second mode of operation.

Representative Paragraph 20. The heat exchange system of Representative Paragraph 19, wherein the first expansion valve is plumbed to receive refrigerant flow from the first set of tubes, and the second expansion valve is plumbed to receive refrigerant flow from the second set of tubes.

Representative Paragraph 21. The heat exchange system of any one of Representative Paragraphs 14, 14.1, 15-17, 17.1, and 18-20, further comprising a first isolation valve is provided in a pipe between the compressor outlet and the second heat exchanger, and a second isolation valve provided in a pipe between the compressor outlet and the second set of tubes, wherein the first isolation valve is shut and the second isolation valve is open in the first mode of operation, and wherein the second isolation valve is shut and the first isolation valve is open in the second mode of operation.

Representative Paragraph 22. The heat exchange system of Representative Paragraph 21, wherein in the first mode of operation the system is aligned such that refrigerant flows from the second heat exchanger, through the second set of tubes (80), through the compressor, through the first set of tubes (60), and then through the first expansion valve before returning to the second heat exchanger, and in the second mode of operation the system is aligned such that refrigerant flows from the second heat exchanger, through the second set of tubes, through the second expansion valve, through the first set of tubes, and then through the compressor before returning to the second heat exchanger.

Representative Paragraph 23. The heat exchange system of Representative Paragraph 22, wherein a first isolation valve 301 is disposed downstream of the compressor and in a first line connected with the second heat exchanger, and a second isolation valve 302 is disposed downstream of the compressor and in a second line connected with the first set of tubes.

Representative Paragraph 24. The heat exchange system of Representative Paragraph 23, wherein the first valve is open and the second valve is shut in the second mode of operation, and the second valve is open and the first valve is shut in the first mode of operation.

Representative Paragraph 25. The heat exchange system of any one of Representative Paragraphs 14-17, 17,1, and 18-24, wherein the second heat exchanger removes heat in the first mode of operation, and the second heat exchanger provides heat in the second mode of operation.

Representative Paragraph 26. The heat exchange system of any one of Representative Paragraphs 14, 14.1, and 15-17, 17.1, and 18-25, wherein the expansion valve is first and second expansion valves, wherein the first expansion valve is disposed proximate to and in fluid communication with the second manifold of the second heat exchanger, and the second expansion valve is disposed in a flow path between the first and second sets of tubes, wherein refrigerant flows through the first expansion valve and does not flow through the second expansion valve when the heat exchange system is operated to remove heat using the second heat exchanger, and wherein refrigerant flows through the second expansion valve and does not flow through the first expansion valve when the heat exchange system is operated to provide a heat using the second heat exchanger.

Representative Paragraph 27. The heat exchange system of Representative Paragraph 26, wherein in the first mode of operation the second manifold of the second heat exchanger is adapted to receive refrigerant flow directly from the first expansion valve, and in the second mode of operation refrigerant flows out of the second manifold of the second heat exchanger and flows to the second set of tubes.

Representative Paragraph 28. The heat exchange system of Representative Paragraph 26, wherein in the second mode of operation the first manifold of the second heat exchanger is adapted to receive refrigerant flowing from the compressor outlet, and in the first mode of operation refrigerant flows out of the first manifold of the second heat exchanger and flows to the second set of tubes.

Representative Paragraph 29. The heat exchange system of Representative Paragraph 29, wherein the outlet of the compressor includes a first flow path that directs refrigerant flow to the first set of tubes and a second flow path that directs refrigerant flow to the first manifold of the second heat exchanger, wherein the first flow path includes a first isolation valve that is open during the first mode of operation and closed during the second mode of operation, and the second flow path includes a second isolation valve that is open during the second mode of operation and closed during the first mode of operation.

Representative Paragraph 30. The heat exchange system of Representative Paragraph 29, wherein the first, second, third, and fourth manifolds are each fluidly connected to two different piped connections, wherein each of the two different piped connections for each of the first, second, third, and fourth manifolds have isolation valves disposed therein in order to prevent or allow refrigerant flow through the respective piped connections.

Representative Paragraph 31. The heat exchange system of Representative Paragraph 30, wherein the isolation valves in each of the two different piped connections for each of the first, second, third, and fourth manifolds are remotely operable between open and closed positions, wherein the controller is configured to send a signal to each isolation valve to instruct the respective isolation valve to be positioned in either the open position or the closed position depending upon whether the system is in the first mode of operation or the second mode of operation.

Representative Paragraph 32. The heat exchange system of any one of Representative Paragraphs 14, 14.1, 15-17, 17.1, and 18-31, further comprising a plurality of fins that extend from tubes within the first set of tubes, and a plurality of fins that extend from tubes within the second set of tubes, wherein the fins from the first set of tubes and fins from the second set of tubes are each configured to allow heat flow from the first set of tubes to the second set of tubes and vice versa.

Representative Paragraph 33. The heat exchange system of any one of Representative Paragraphs 14, 14.1, and 15-17, 17.1, and 18-32, further comprising a plurality of four-way valves that are configured to be arranged in a first condition to cause flow as desired within the system for the first mode of operation and are configured to be arranged in a second condition to cause flow as desired within the system for the second mode of operation.

Representative Paragraph 34. A method of operating a heat exchange system in order to operate a second heat exchanger within an indoor space to selectively provide cooling in the indoor space and provide heating in the indoor space:

providing a second heat exchanger that is disposed within an interior space, wherein the second heat exchanger comprises first and second manifolds that are disposed at opposite ends of one or more flowpaths that are fluidly connected with both of the first set of tubes and the second set of tubes;

providing a first heat exchange assembly that is configured to be disposed in an outdoor space configured for outside air to flow therethrough, the second heat exchange assembly comprising:

a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

operating a compressor, and providing an expansion valve such that refrigerant flows through the system flows through the expansion valve, when desired to provide cooling within the indoor space, operating the system in a first mode of operation, aligning the system such that refrigerant that flows through the compressor reaches the compressor after flowing through the second set of tubes and upon leaving a compressor outlet flows through the first set of tubes, and when desired to provide heating within the indoor space, operating the system in the second mode of operation, aligning the system such that refrigerant that flows through the compressor reaches the compressor after flowing through the first set of tubes and upon leaving the compressor outlet flows through the second heat exchanger before flowing through the second set of tubes.

Representative Paragraph 34. The method of Representative Paragraph 33, wherein the first mode of operation, the second heat exchanger is an evaporator, the second set of tubes is a superheater, and the first set of tubes is a condenser.

Representative Paragraph 36. The method of Representative Paragraph 34, wherein in the second mode of operation, the second heat exchanger is a condenser, the second set of tubes is a subcooler, and the first set of tubes is an evaporator.

Representative Paragraph 37. The method of Representative Paragraph 35, wherein in the second mode of operation, the first heat exchanger is a condenser, the first set of tubes is a subcooler, and the second set of tubes is an evaporator.

Representative Paragraph 38. The method of Representative Paragraph 34, wherein when the system is operated in the first mode of operation, the expansion valve is aligned to receive refrigerant flow from the first set of tubes and to direct flow from the expansion valve to the second heat exchanger;

wherein when the system is operated in the second mode of operation, the expansion valve is aligned to receive refrigerant flow from the second set of tubes and direct flow from the expansion valve to the first set of tubes.

Representative Paragraph 39. The method of Representative Paragraph 38, wherein the expansion valve includes first and second expansion valves, wherein in the first mode of operation the first expansion valve is aligned to receive refrigerant flow and the second expansion valve is not aligned to receive refrigerant flow, and when in the second mode of operation the second expansion valve is aligned to receive refrigerant flow and the first expansion valve is not aligned to receive refrigerant flow.

Representative Paragraph 40. The method of Representative Paragraph 34, further comprising providing a first isolation valve within a first pipe between the compressor outlet and the first set of tubes, and a second isolation valve in a second pipe between the compressor outlet and second heat exchanger, wherein when in the first mode of operation the first valve is open and the second valve is shut, and when in the second mode of operation the second valve is open and the first valve is shut.

Representative Paragraph 41. The method of Representative Paragraph 40, further comprising when in the first mode of operation aligning the system such that refrigerant flows from the second heat exchanger, through the second set of tubes, through the compressor, through the first set of tubes, and then through the expansion valve before returning to the second heat exchanger, and when in the second mode of operation the system is aligned such that refrigerant flows from the second heat exchanger, through the second set of tubes, through the expansion valve, through the first set of tubes, and then through the compressor before returning to the second heat exchanger.

The invention claimed is:

1. A heat exchange system comprising:

a first heat exchange assembly that is configured to be disposed in an outdoor space configured for outside air to flow therethrough, the first heat exchange assembly comprising:

a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

a second heat exchanger that is disposed within an interior space, wherein the second heat exchanger comprises first and second manifolds that are disposed at opposite ends of one or more flowpaths that are fluidly connected with both of the first set of tubes and the second set of tubes;

a compressor, and an expansion valve, wherein in a first mode of operation refrigerant that flows through the compressor reaches the compressor after flowing through the second set of tubes and upon leaving a compressor outlet flows through the first set of tubes, and wherein in a second mode of operation refrigerant that flows through the compressor reaches the compressor after flowing through the first set of tubes and upon leaving the compressor outlet flows through the second heat exchanger before flowing through the second set of tubes.

2. The heat exchange system of claim 1, wherein each of the tubes of the first set of tubes are formed with the same geometry and size and each of the tubes within the second set of tubes are formed with the same geometry and size.

3. The heat exchange system of claim 1, wherein the expansion valve comprises first and second expansion valves, wherein the first expansion valve is disposed within the interior space, and the second expansion valve is disposed within the outdoor space, wherein the system is configured to only allow refrigerant flow through one of the first expansion valve in the first mode of operation, and the system is configured to only allow refrigerant to flow through the second expansion valve during the second mode of operation.

4. The heat exchange system of claim 3, wherein the first expansion valve is plumbed to receive refrigerant flow from the first set of tubes, and the second expansion valve is plumbed to receive refrigerant flow from the second set of tubes.

5. The heat exchange system of claim 1, further comprising a first isolation valve is provided in a pipe between the compressor outlet and the second heat exchanger, and a second isolation valve provided in a pipe between the compressor outlet and the second set of tubes, wherein the first isolation valve is shut and the second isolation valve is open in the first mode of operation, and wherein the second isolation valve is shut and the first isolation valve is open in the second mode of operation.

6. The heat exchange system of claim 4, wherein in the first mode of operation the system is aligned such that refrigerant flows from the second heat exchanger, through the second set of tubes, through the compressor, through the first set of tubes, and then through the first expansion valve before returning to the second heat exchanger, and in the second mode of operation the system is aligned such that refrigerant flows from the second heat exchanger, through the second set of tubes, through the second expansion valve, through the first set of tubes, and then through the compressor before returning to the second heat exchanger.

7. The heat exchange system of claim 6, wherein a first isolation valve is disposed downstream of the compressor and in a first line connected with the second heat exchanger, and a second isolation valve is disposed downstream of the compressor and in a second line connected with the first set of tubes.

8. The heat exchange system of claim 7, wherein the first valve is open and the second valve is shut in the second mode of operation, and the second valve is open and the first valve is shut in the first mode of operation.

9. The heat exchange system of claim 1, wherein the second heat exchanger removes heat in the first mode of operation, and the second heat exchanger provides heat in the second mode of operation.

10. The heat exchange system of claim 1, wherein the expansion valve is first and second expansion valves, wherein the first expansion valve is disposed proximate to and in fluid communication with the second manifold of the second heat exchanger, and the second expansion valve is disposed in a flow path between the first and second sets of tubes, wherein refrigerant flows through the first expansion valve and does not flow through the second expansion valve when the heat exchange system is operated to remove heat using the second heat exchanger, and wherein refrigerant flows through the second expansion valve and does not flow through the first expansion valve when the heat exchange system is operated to provide a heat using the second heat exchanger.

11. The heat exchange system of claim 10, wherein in the first mode of operation the second manifold of the second heat exchanger is adapted to receive refrigerant flow directly from the first expansion valve, and in the second mode of operation refrigerant flows out of the second manifold of the second heat exchanger and flows to the second set of tubes.

12. The heat exchange system of claim 10, wherein in the second mode of operation the first manifold of the second heat exchanger is adapted to receive refrigerant flowing from the compressor outlet, and in the first mode of operation refrigerant flows out of the first manifold of the second heat exchanger and flows to the second set of tubes.

13. The heat exchange system of claim 12, wherein the outlet of the compressor includes a first flow path that directs refrigerant flow to the first set of tubes and a second flow path that directs refrigerant flow to the first manifold of the second heat exchanger, wherein the first flow path includes a first isolation valve that is open during the first mode of operation and closed during the second mode of operation, and the second flow path includes a second isolation valve that is open during the second mode of operation and closed during the first mode of operation.

14. The heat exchange system of claim 13, wherein the first, second, third, and fourth manifolds are each fluidly connected to two different piped connections, wherein each of the two different piped connections for each of the first, second, third, and fourth manifolds have isolation valves disposed therein in order to prevent or allow refrigerant flow through the respective piped connections.

15. The heat exchange system of claim 14, wherein the isolation valves in each of the two different piped connections for each of the first, second, third, and fourth manifolds are remotely operable between open and closed positions, wherein the controller is configured to send a signal to each isolation valve to instruct the respective isolation valve to be positioned in either the open position or the closed position depending upon whether the system is in the first mode of operation or the second mode of operation.

16. The heat exchange system of claim 1, further comprising a plurality of fins that extend from tubes within the first set of tubes, and a plurality of fins that extend from tubes within the second set of tubes, wherein the fins from the first set of tubes and fins from the second set of tubes are each configured to allow heat flow from the first set of tubes to the second set of tubes and vice versa.

17. A method of operating a heat exchange system in order to operate a second heat exchanger within an indoor space to selectively provide cooling in the indoor space and provide heating in the indoor space:

providing a second heat exchanger that is disposed within an interior space, wherein the second heat exchanger comprises first and second manifolds that are disposed at opposite ends of one or more flowpaths that are fluidly connected with both of the first set of tubes and the second set of tubes;

providing a first heat exchange assembly that is configured to be disposed in an outdoor space configured for outside air to flow therethrough, the second heat exchange assembly comprising:

a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

operating a compressor, and providing an expansion valve such that refrigerant flows through the system flows through the expansion valve, when desired to provide cooling within the indoor space, operating the system in a first mode of operation, aligning the system such that refrigerant that flows through the compressor reaches the compressor after flowing through the second set of tubes and upon leaving a compressor outlet flows through the first set of tubes, and when desired to provide heating within the indoor space, operating the system in the second mode of operation, aligning the system such that refrigerant that flows through the compressor reaches the compressor after flowing through the first set of tubes and upon leaving the compressor outlet flows through the second heat exchanger before flowing through the second set of tubes.

18. The method of claim 17, wherein the first mode of operation, the second heat exchanger is an evaporator, the second set of tubes is a superheater, and the first set of tubes is a condenser.

19. The method of claim 17, wherein in the second mode of operation, the second heat exchanger is a condenser, the second set of tubes is a subcooler, and the first set of tubes is an evaporator.

20. The method of claim 18, wherein in the second mode of operation, the first heat exchanger is a condenser, the first set of tubes is a subcooler, and the second set of tubes is an evaporator.

21. The method of claim 17, wherein when the system is operated in the first mode of operation, the expansion valve is aligned to receive refrigerant flow from the first set of tubes and to direct flow from the expansion valve to the second heat exchanger;

wherein when the system is operated in the second mode of operation, the expansion valve is aligned to receive refrigerant flow from the second set of tubes and direct flow from the expansion valve to the first set of tubes.

22. The method of claim 21, wherein the expansion valve includes first and second expansion valves, wherein in the first mode of operation the first expansion valve is aligned to receive refrigerant flow and the second expansion valve is not aligned to receive refrigerant flow, and when in the second mode of operation the second expansion valve is aligned to receive refrigerant flow and the first expansion valve is not aligned to receive refrigerant flow.

23. The method of claim 17, further comprising providing a first isolation valve within a first pipe between the compressor outlet and the first set of tubes, and a second isolation valve in a second pipe between the compressor outlet and second heat exchanger, wherein when in the first mode of operation the first valve is open and the second valve is shut, and when in the second mode of operation the second valve is open and the first valve is shut.

24. The method of claim 23, further comprising when in the first mode of operation aligning the system such that refrigerant flows from the second heat exchanger, through the second set of tubes, through the compressor, through the first set of tubes, and then through the expansion valve before returning to the second heat exchanger, and when in the second mode of operation the system is aligned such that refrigerant flows from the second heat exchanger, through the second set of tubes, through the expansion valve, through the first set of tubes, and then through the compressor before returning to the second heat exchanger.

25. A heat exchange system comprising:

a first heat exchange assembly that is configured to be disposed in an outdoor space configured for outside air to flow therethrough, the first heat exchange assembly comprising:

a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

a second heat exchanger that is disposed within an interior space, wherein the second heat exchanger comprises first and second manifolds that are disposed at opposite ends of one or more flowpaths that are fluidly connected with both of the first set of tubes and the second set of tubes;

a compressor, and an expansion valve, and wherein in a first mode of operation refrigerant that flows through the compressor reaches the compressor after flowing through the second set of tubes and upon leaving a compressor outlet flows through the first set of tubes.

* * * * *